US012202032B2

(12) United States Patent
Huang et al.

(10) Patent No.: US 12,202,032 B2
(45) Date of Patent: Jan. 21, 2025

(54) FORGED GOLF CLUB HEAD

(71) Applicant: KARSTEN MANUFACTURING CORPORATION, Phoenix, AZ (US)

(72) Inventors: Yujen Huang, Pingtung (TW); Erik M. Henrikson, Phoenix, AZ (US); Matthew W. Simone, Phoenix, AZ (US); Matthew T. Schier, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 138 days.

(21) Appl. No.: 18/177,719

(22) Filed: Mar. 2, 2023

(65) Prior Publication Data

US 2023/0201911 A1 Jun. 29, 2023

Related U.S. Application Data

(63) Continuation-in-part of application No. 17/654,555, filed on Mar. 11, 2022, now abandoned, which is a (Continued)

(51) Int. Cl.

| | |
|---|---|
| ***A63B 53/04*** | (2015.01) |
| ***B21J 9/02*** | (2006.01) |
| ***B21K 17/00*** | (2006.01) |

(52) U.S. Cl.

CPC ..... *B21K 17/00* (2013.01); *A63B 53/04* (2013.01); *A63B 53/047* (2013.01); *B21J 9/022* (2013.01);

(Continued)

(58) Field of Classification Search

CPC . A63B 53/04; A63B 53/0412; A63B 53/0475; A63B 53/0408; A63B 53/047;

(Continued)

(56) References Cited

U.S. PATENT DOCUMENTS

| | | | |
|---|---|---|---|
| 1,673,994 | A | 6/1928 | Williams |
| 6,030,295 | A | 2/2000 | Takeda |

(Continued)

FOREIGN PATENT DOCUMENTS

| | | |
|---|---|---|
| CN | 100469407 | 3/2009 |
| CN | 105268167 | 1/2016 |

(Continued)

OTHER PUBLICATIONS

International Search Report / Written Opinion from PCT Application No. PCT/US2019/051587, mailing date Dec. 4, 2019.

*Primary Examiner* — John E Simms, Jr.

(57) ABSTRACT

An iron-type golf club head with a cavity formed via a multi-stage forging process. The forged iron-type golf club head is formed from a single billet of material. An intermediate step of the multi-stage forging process creates a cavity in the iron-type golf club head which can receive an insert. The resultant iron-type golf club head has a substantially lower center of gravity and higher moment of inertia when compared to a traditionally forged iron-type golf club head lacking a cavity. Additionally, the resultant iron-type golf club head has a more solid feel than a traditionally cast iron-type golf club head as a result of the tighter grain structure the forging process yields.

20 Claims, 17 Drawing Sheets

Related U.S. Application Data continuation of application No. 16/573,938, filed on Sep. 17, 2019, now Pat. No. 11,273,486.

(60) Provisional application No. 63/378,811, filed on Oct. 7, 2022, provisional application No. 63/373,831, filed on Aug. 29, 2022, provisional application No. 63/364,949, filed on May 18, 2022, provisional application No. 63/363,780, filed on Apr. 28, 2022, provisional application No. 63/269,232, filed on Mar. 11, 2022, provisional application No. 62/732,438, filed on Sep. 17, 2018.

(52) U.S. Cl.
CPC ..... *A63B 53/0412* (2020.08); *A63B 53/0475* (2013.01); *A63B 2053/0479* (2013.01); *A63B 2209/00* (2013.01)

(58) Field of Classification Search
CPC .... A63B 2053/0483; A63B 2053/0491; A63B 2053/0479; B21K 17/00
See application file for complete search history.

(56) References Cited

U.S. PATENT DOCUMENTS

| | | | | |
|---|---|---|---|---|
| 6,083,118 | A | 7/2000 | Martins | |
| 6,267,690 | B1 | 7/2001 | Salmon | |
| 6,497,629 | B2 | 12/2002 | Takeda | |
| 6,666,779 | B1 | 12/2003 | Iwata | |
| 6,709,345 | B2 | 3/2004 | Iwata | |
| 6,921,344 | B2 | 7/2005 | Gilbert | |
| 7,867,105 | B2 | 1/2011 | Moon | |
| 7,976,403 | B2 | 7/2011 | Gilbert | |
| 7,980,960 | B2 | 7/2011 | Gilbert | |
| 8,206,237 | B2 | 6/2012 | Gilbert | |
| 8,388,464 | B2 | 3/2013 | Gilbert | |
| 8,668,598 | B2 | 3/2014 | Gilbert | |
| 8,821,313 | B1 | 9/2014 | Dawson | |
| 9,101,974 | B2 | 8/2015 | Liang | |
| 9,522,311 | B2 | 12/2016 | Doi | |
| 9,616,305 | B2 | 4/2017 | Hettinger | |
| 11,273,486 | B2 | 3/2022 | Huang | |
| 11,465,018 | B2 | 10/2022 | Stokke | |
| 2002/0065140 | A1* | 5/2002 | Iwata | A63B 53/04 473/291 |
| 2002/0095762 | A1 | 7/2002 | Takeda | |
| 2005/0233825 | A1 | 10/2005 | Tsai | |
| 2005/0277484 | A1* | 12/2005 | Reed | A63B 53/047 473/332 |
| 2006/0035721 | A1* | 2/2006 | Knutson | A63B 53/047 473/335 |
| 2006/0094532 | A1 | 5/2006 | Seeley | |
| 2006/0196037 | A1 | 9/2006 | Tsai | |
| 2006/0293119 | A1 | 12/2006 | Hou | |
| 2008/0058119 | A1 | 3/2008 | Soracco | |
| 2009/0111603 | A1 | 4/2009 | Romero | |
| 2009/0298615 | A1* | 12/2009 | Moon | A63B 53/047 473/282 |
| 2011/0201444 | A1 | 8/2011 | Stokke | |
| 2012/0196702 | A1* | 8/2012 | Shimazaki | A63B 53/047 473/345 |
| 2013/0344988 | A1 | 12/2013 | Hettinger | |
| 2014/0274456 | A1 | 9/2014 | Cardani | |
| 2014/0295993 | A1* | 10/2014 | Tsurumaki | A63B 60/52 473/350 |
| 2015/0072804 | A1 | 3/2015 | Doi | |
| 2016/0008871 | A1 | 1/2016 | Su | |
| 2016/0144248 | A1* | 5/2016 | Chen | A63B 53/0475 29/592 |
| 2016/0151861 | A1 | 6/2016 | Soracco | |
| 2017/0120112 | A1 | 5/2017 | Stokke | |
| 2017/0282025 | A1* | 10/2017 | Petersen | A63B 60/02 |
| 2018/0056151 | A1* | 3/2018 | Doi | A63B 53/047 |
| 2018/0256946 | A1* | 9/2018 | Stokke | A63B 53/047 |
| 2019/0329107 | A1* | 10/2019 | Petersen | A63B 60/54 |
| 2020/0038720 | A1* | 2/2020 | Stokke | A63B 60/00 |

FOREIGN PATENT DOCUMENTS

| | | |
|---|---|---|
| CN | 109664072 | 4/2019 |
| CN | 111250927 | 6/2020 |
| JP | H10314347 | 12/1998 |
| JP | 3072642 | 10/2000 |
| JP | 6737551 | 8/2020 |
| JP | 6803721 | 12/2020 |

* cited by examiner

FORGED GOLF CLUB HEAD

CROSS REFERENCE PRIORITIES

This claims benefit of U.S. Provisional Application No. 63/363,780, filed Apr. 28, 2022, U.S. Provisional Application No. 63/364,949, filed May 18, 2022, U.S. Provisional Application No. 63/373,831, filed Aug. 29, 2022, U.S. Provisional Application No. 63/378,811, filed Oct. 7, 2022, and U.S. Provisional Application No. 63/269,232, filed Mar. 11, 2022, and is a continuation-in-part of U.S. patent application Ser. No. 17/654,555, filed Mar. 11, 2022, which is a continuation of U.S. patent application Ser. No. 16/573,938, filed Sep. 17, 2019, now U.S. Pat. No. 11,273,486, issued on Mar. 15, 2022, which claims benefit of U.S. Provisional Application No. 62/732,438, filed on Sep. 17, 2018, the contents of which are fully incorporated herein by reference.

TECHNICAL FIELD

This disclosure relates generally to golf clubs and relates more particularly to a method of manufacturing a forged iron with a cavity.

BACKGROUND

In general, iron type golf club heads can be made by a variety of methods such as casting, co-casting, metal injection molding, machine milling, and forging. Many iron type golf club heads contain cavities or filling features to adjust the performance features of the golf club head when it strikes a golf ball. Often times, irons that contain cavities are cast or co-cast in order to achieve these advanced geometries. Milling techniques are used to create club heads with cavities from a single block of material, however this is an expensive and time-consuming process. Forging techniques are often used to create an iron golf club head that is formed of an integral block of material. Forging is cheaper and quicker than milling. The forged geometries, however, are limiting, especially designs for cavities and variations in face plates. With current industry techniques, it is difficult to quickly and cheaply create a forged iron type club head with any kind of cavity. There is a need in the art for a forged golf club head with a cavity.

BRIEF DESCRIPTION OF THE DRAWINGS

To facilitate further description of the embodiments, the following drawings are provided in which.

Figure 1:
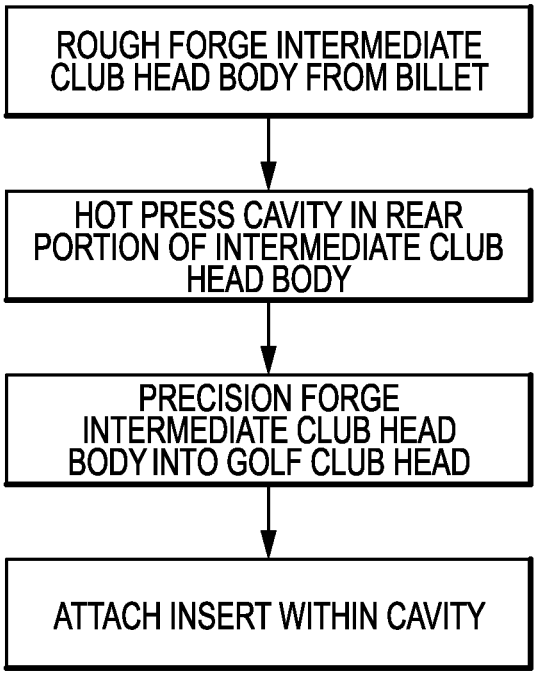
FIG. 1 illustrates a flow diagram representation of one embodiment in which the exemplary golf club heads can be manufactured.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

Described herein is a forged iron type golf club head with a rear cavity that is manufactured via a multi-stage forging process. The forged iron type golf club head is formed from a single billet of material and comprises a rear cavity configured to receive an elastomeric insert. The rear cavity is formed via an intermediate forging step. The forged iron type golf club head comprising a rear cavity has a substantially lower center of gravity and higher moment of inertia compared to traditionally forged irons due to the use of the elastomeric insert. The elastomeric insert and cavity provide mass savings that can be reallocated to other portions of the club head to lower the center of gravity and increase the moment of inertia. The forged iron further comprises a tighter grain structure resulting in a more solid feeling iron that is characteristic of forged clubs.

The forged iron type golf club head with a rear cavity can further comprise various geometries to improve the ease of manufacture and adjust mass properties. In some embodiments, the rear forged cavity can comprise a narrow and deep cavity to improve strike face flexure. In other embodiments, the forged cavity can comprise a shallow and wide cavity to improve ease of manufacturing. In other embodiments, the forged iron type golf club head can comprise various thicknesses in different regions of the strike face, like in a top region, middle region, or bottom region, to improve the strike face bending during the rough forging step described above. The rear wall of the forged iron type golf club head can comprise a sufficiently large surface area and angle to improve the effective angle so that hot press tool has sufficient clearance to create the cavity.

The forged iron type golf club is manufactured by a multi-stage forging process. The method comprises: rough forging solid block billet of a suitable metal to create an intermediate club head body, machining the rough dimensions of a cavity into the club head, hot pressing the machined cavity to form a final cavity with precise dimensions, precision forging the intermediate club head to finalize the cavity, precision forming the golf club head body to create the final details and textures, and then attaching an insert within the cavity. The intermediate club head, formed through rough forging, comprises a bent strike face, allowing a cavity to be formed in the rear body via hot pressing. The temporarily bent strike face allows a cavity to be formed by providing a forging path that would otherwise be blocked by the strike face. The bent strike face of the intermediate club head is then precision forged back to a flat strike face, creating a final, manufactured golf club head. This bent strike face technique allows a manufacturer to create a forged golf club head body with a deep undercut cavity, from a single solid billet, as the bent strike face provides room to hot press a cavity.

Definitions

It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. Furthermore, the term "rough forging" describes a forging technique wherein a block shaped billet is quickly formed into a general desired shape, with minimal tooling or machining.

The term "strike face," as described herein, refers to a club head front surface that is configured to strike a golf ball. The term strike face can be used interchangeably with the term "face."

The term "strike face perimeter," as described herein, can refer to an edge of the strike face. The strike face perimeter can be located along an outer edge of the strike face where the curvature deviates from a bulge and/or roll of the strike face.

The term "geometric centerpoint," or "geometric center" of the strike face, as described herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as described herein, can refer to a reference plane associated with the surface on which a golf ball is placed. The ground plane can be a horizontal plane tangent to the sole at an address position.

The term "loft plane," as described herein, can refer to a reference plane that is tangent to the strike face at the geometric centerpoint.

The term "loft angle," as described herein, can refer to an angle measured between the loft plane and the XY plane (defined below).

The term "face height," as described herein, can refer to a distance measured parallel to loft plane between a top end of the strikeface perimeter and a bottom end of the strikeface perimeter.

The term "lie angle," as described herein, can refer to an angle between a hosel axis, extending through the hosel, and the ground plane. The lie angle is measured from a front view.

The "depth" of the golf club head, as described herein, can be defined as a front-to-rear dimension of the golf club head.

The "height" of the golf club head, as described herein, can be defined as a top rail-to sole dimension of the golf club head. In many embodiments, the height of the club head can be measured according to a golf governing body such as the United States Golf Association (USGA).

The "length" of the golf club head, as described herein, can be defined as a heel-to-toe dimension of the golf club head. In many embodiments, the length of the club head can be measured according to a golf governing body such as the United States Golf Association (USGA).

The "face height" of the golf club head, as described herein, can be defined as a height measured parallel to loft plane between a top end of the strike face perimeter near the top rail and a bottom end of the strike face perimeter near the sole.

The "geometric center height" of the golf club head, as described herein, is a height measured perpendicular from the ground plane to the geometric centerpoint of the golf club head.

The "leading edge" of the club head, as described herein, can be identified as the most sole-ward portion of the strike face perimeter.

An "XYZ" coordinate system of the golf club head, as described herein, is based upon the geometric center of the strike face. The golf club head dimensions as described herein can be measured based on a coordinate system as defined below. The geometric center of the strike face defines a coordinate system having an origin located at the geometric center of the strike face. The coordinate system defines an X axis, a Y axis, and a Z axis. The X axis extends through the geometric center of the strike face in a direction from the heel to the toe of the club head. The Y axis extends through the geometric center of the strike face in a direction from the top rail to the sole of golf club head. The Y axis is perpendicular to the X axis. The Z axis extends through the geometric center of the strike face in a direction from the front end to the rear end of the golf club head. The Z axis is perpendicular to both the X axis and the Y axis.

The term or phrase "center of gravity position" or "CG location" can refer to the location of the club head center of gravity (CG) with respect to the XYZ coordinate system, wherein the CG position is characterized by locations along the X-axis, the Y-axis, and the Z-axis. The term "CGx" can refer to the CG location along the X-axis, measured from the origin point. The term "CG height" can refer to the CG location along the Y-axis, measured from the origin point. The term "CGy" can be synonymous with the CG height. The term "CG depth" can refer to the CG location along the Z-axis, measured from the origin point. The term "CGz" can be synonymous with the CG depth.

The XYZ coordinate system of the golf club head, as described herein defines an XY plane extending through the X axis and the Y axis. The coordinate system defines XZ plane extending through the X axis and the Z axis. The coordinate system further defines a YZ plane extending through the Y axis and the Z axis. The XY plane, the XZ plane, and the YZ plane are all perpendicular to one another and intersect at the coordinate system origin located at the geometric center of the strike face. In these or other embodiments, the golf club head can be viewed from a front view when the strike face is viewed from a direction perpendicular to the XY plane. Further, in these or other embodiments, the golf club head can be viewed from a side view or side cross-sectional view when the heel is viewed from a direction perpendicular to the YZ plane.

The golf club head further comprises a coordinate system centered about the center of gravity. The coordinate system comprises an X'-axis, a Y'-axis, and a Z'-axis. The X'-axis extends in a heel-to-toe direction. The X'-axis is positive towards the heel and negative towards the toe. The Y'-axis extends in a sole-to-top direction and is orthogonal to both the Z'-axis and the X'-axis. The Y'-axis is positive towards the top rail and negative towards the sole. The Z-axis extends front-to-rear, parallel to the ground plane and is orthogonal to both the X'-axis and the Y'-axis. The Z'-axis is positive towards the strike face and negative towards the rear.

The term or phrase "moment of inertia" (hereafter "MOI") can refer to values measured about the CG. The term "MOIxx" can refer to the MOI measured in the heel-to-toe direction, parallel to the X'-axis. The term "MOIyy" can refer to the MOI measured in the sole-to-top rail direction, parallel to the Y-axis. The term "MOIzz" can refer to the MOI measured in the front-to-back direction, parallel to the Z-axis. The MOI values MOIxx, MOIyy, and MOIzz determine how forgiving the club head is for off-center impacts with a golf ball.

The term "iron," as described herein, can, in some embodiments, refer to an iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The term "wedge" as described herein, can, in some embodiments, refer to a wedge-type golf club head having a loft that is greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, or greater than approximately 50 degrees. Further, in many embodiments, the loft of the wedge-type golf club head is less than approximately 65 degrees, less than approximately 64 degrees, less than approximately 63 degrees, less than approximately 62 degrees, less than approximately 61 degrees, or less than approximately 60 degrees.

In many embodiments, such as for "game improvement irons", the volume of the club head is less than approximately 65 cm3, less than approximately 60 cm3, less than approximately 55 cm3, or less than approximately 50 cm3. In some embodiments, the volume of the club head can be approximately 50 cm3 to 60 cm3, approximately 51 cm3-53 cm3, approximately 53 cm3-55 cm3, approximately 55 cm3-57 cm3, or approximately 57 cm3-59 cm3.

In many embodiments, such as for "player's irons", the volume of the club head is less than approximately 45 cm3, less than approximately 40 cm3, less than approximately 35 cm3, or less than approximately 30 cm3. In some embodiments, the volume of the club head can be approximately 31 cm3-38 cm3 (1.9 cubic inches to 2.3 cubic inches), approximately 31 cm3-33 cm3, approximately 33 cm3-35 cm3, approximately 35 cm3-37 cm3, or approximately 37 cm3-39 cm3.

In some embodiments, the iron can comprise a total mass ranging between 180 grams and 300 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In general, methods, apparatuses, and articles of manufacture associated with golf clubs, and in particular golf club heads are described herein. The methods, apparatuses, and articles of manufacture described herein are not limited in this regard.

DESCRIPTION

Described herein is a method of manufacturing (multi-stage forging process) a forged iron-type golf club head with a cavity. The forged iron-type golf club head made through the multi-stage forging process achieves similar geometries and mass properties of similar cast clubs while having beneficial material properties and ease of manufacturing achieve through forging. The forged iron-type golf club head comprises a rear cavity which is configured to receive an insert. The cavity and the insert increases discretionary mass that may be allocated to other portions of the club head such as the perimeter portion and the sole to increase the moment of inertia and lower the center of gravity, respectively.

FIGS. 1-4 illustrate the method of manufacturing (multi-stage forging process) a forged iron-type golf club head with a cavity. The method of manufacturing the iron-type golf club head with a cavity comprises a rough forging stage, a hot-pressing stage, and a precision forging stage. The method of manufacturing a forged iron-type golf club head with cavity, illustrated in FIG. 5, can form a single iron-type golf club head with cavity, or a set of iron-type golf club heads with cavities.

A single iron-type golf club head with cavity, formed by the multi-stage forging process, can comprise a loft angle ranging between 60 degrees and 16 degrees. In many embodiments, the loft angle of the club head is less than approximately 60 degrees, the loft angle of the club head is less than approximately 59, degrees, the loft angle of the club head is less than approximately 58 degrees, the loft angle of the club head is less than approximately 57 degrees the loft angle of the club head is less than approximately 56 degrees, the loft angle of the club head is less than approximately 55 degrees, the loft angle of the club head is less than approximately 54 degrees, the loft angle of the club head is less than approximately 53 degrees, the loft angle of the club head is less than approximately 52 degrees, the loft angle of the club head is less than approximately 51 degrees, the loft angle of the club head is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further still, the multi-stage forging process can form multiple iron-type golf club heads with cavities, wherein the multiple iron-type golf club heads with cavities will comprise different lofts (aforementioned) to form a set of golf clubs (i.e., 2, iron, 3 iron, 4 iron, 5 iron, 6 iron, 7 iron, 8 iron, 9 iron, PW). In some embodiments, the multi-stage forging process can form multiple iron-type golf club heads with identically sized cavities, and different lofts to form a set of golf clubs.

A. Rough Forging

Referring to FIG. 1, the multi-stage forging method, comprises four stages: (1) a rough forging stage, in which intermediate club head body 10 is formed from a solid block billet (not shown); (2) a hot-pressing stage, in which a cavity 58 is formed in the intermediate club head body; (3) a precision forging stage wherein the intermediate club head body 10 is formed into a final golf club head 80; (4) and an insert 110 or filling is placed within the cavity 58 of the golf club head body 80. This multi-stage forging method allows a manufacturer to create a forged golf club head 80 with a deep undercut cavity 58, from a single solid billet. In some embodiments, the multi-stage forging method can comprise a fifth stage (not shown), wherein a shaft and grip are attached to the golf club head body 80, to form a golf club.

To begin the multi-stage forging method, a billeted material is provided. The billet is forged into an iron type golf club head and can be any one or more combination of the following: 8620 alloy steel, S25C steel, carbon steel, maraging steel, stainless steel, stainless steel alloy, tungsten, aluminum, aluminum alloy, or any metal suitable for forging. The billet can be a solid block with no cavities or other materials attached to the billet. Further, the billet does not monolithically encase any other material. The one or more materials can be present on the surface of the billet, multiple surfaces of the billet, or a corner of the billet.

In another embodiment, the solid billet can include two or more metals. The multi-metal billet is forged into an iron type golf club head and can be any one or more combination of the following: 8620 alloy steel, S25C steel, carbon steel, maraging steel, stainless steel, stainless steel alloy, tungsten, aluminum, aluminum alloy, or any metal suitable for forging. The multi-metal billet does not monolithically encase any other material. The multi-metal billet can comprise a base metal, with at least one different metal on the surface of the billet, at least one different metal on multiple surface of the billet, or at least one different metal on a corner of the billet.

Figure 2:
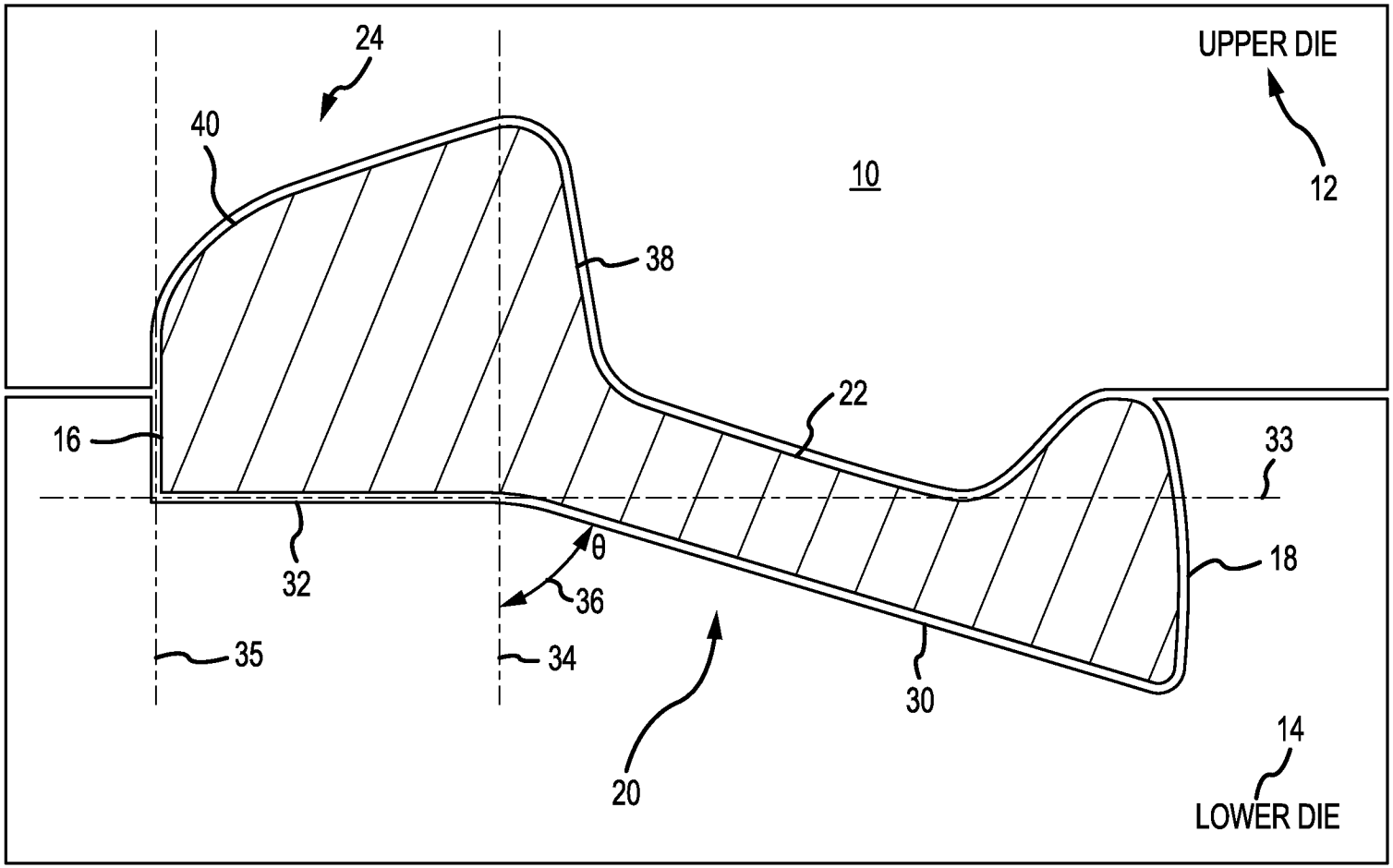
FIG. 2 illustrates a cross-sectional view of a club head during a multi-stage forging method.

The next step of the multi-stage forging process is to forge the billet to into an intermediate club head 10. Referring to FIG. 2, the intermediate club head body 10 is formed from a solid block billet that is rough forged by a first upper die 12 and a first lower die 14. The first upper die 12 and first lower die 14 are shaped in a desired club head geometry. The solid block billet is heated to a desired temperature between 700° C. and 1100° C., making the billet very malleable, thus allowing forging to occur. In some embodiments, the desired billet temperature for rough forging is between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C. In one embodiment, the desired billet temperature for rough forging is between 800-825° C.

Once the solid block billet is heated to a desired temperature, the first upper die 12 and first lower die 14 apply a desired pressure to the billet, shaping the malleable billet to the shape of the desired geometry. The desired pressure that is applied to the billet by the first upper die 12 and the first lower die 14 is between 500 tons and 800 tons (1 ton is equivalent to 2000 pounds force). In some embodiments, the desired pressure of the upper die 12 and lower die 14 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the upper die 12 and lower die 14 is between 600 tons and 625 tons. The extreme pressure of the upper die 12 and lower die 14, quickly forms the malleable solid block billet to the desired geometry, thus maintaining the material and tensile properties of the metallic billet.

Referring to FIG. 2, is a cross-sectional view of the upper die 12 and lower die 14 forming the intermediate club head body 10, from the solid block billet. The intermediate club head body 10 that is formed from the rough forging comprises: a sole 16, a top rail 18, a strike face 20, a back wall 22 of the strike face 20, and a rear portion 24. The strike face 20 has a heel end (not shown), a toe end (not shown), an upper region 30, a lower region 32, and a strike plane 33. The strike plane 33 is parallel to the lower region 32 of the strike face 20 and is the desired plane that the strike face 20 will be bent to in a later step. The upper region 30 is opposite the back wall 22 of the strike face 20, while the lower region 32 is opposite the rear portion 24.

The rear portion 24 extends away from the strike face 20 and is adjacent the sole 16. Further, the rear portion 24 comprises an upper edge 38. The upper edge 38 is approximately perpendicular to the strike plane 33 and the lower region 32. The upper edge 38 provides a surface, or ledge, to form a cavity within, in a later step. The rear portion 24 further comprises a nonlinear outer periphery 40. The upper edge 38 spans the back wall of the strike face 22 from the heel end to the toe end. The nonlinear outer periphery 40 connects the sole 16 to the upper edge 38 of the rear portion 24.

The back wall 22 of the strike face 20, is adjacent to the top rail 18 and to the upper edge 38, while parallel to the upper region 30 of the strike face 20. The back wall 22 of the strike face 20 spans approximately from the heel end to the toe end.

The upper region 30 and lower region 32 of the strike face of the intermediate club head body 10, are divided by an intersection plane 34, wherein the intersection plane 34 is perpendicular to the lower region 32 of the strike face 20 and the strike plane 33. The intersection plane 34 is also approximately parallel to the upper edge 38 of the rear portion 24. The intersection plane 34 enables the forging of a cavity in the rear portion 24 of the intermediate club head body 10. The intersection plane 34 is the plane that which the strike face 20 is bent about and is a bending point for creating the cavity 58 from the forged billet.

The intersection plane 34 runs approximately parallel to a ground plane 35, wherein the ground plane 35 intersects the sole 16. In most embodiments, the ground plane 35 is tangential to and parallel to the sole 16. In some embodiments, the ground plane 35 intersects the sole 16 at an angle, not parallel to sole 16.

Further still, the intersection plane 34 intersects the strike face of the intermediate club head body 10, approximately bisecting the intermediate club head body 10, dividing the upper region 30 and the lower region 32. The intermediate club head body 10, further comprises a height measured from the sole 16 to the top rail 18. In most embodiments, the intersection plane 34 intersect the intermediate club head body 10 between 20-70% of the height of the club head body 10. In some embodiments, the intersection plane 34 intersects the club head body 10 at approximately 20%, 25%, 30%, 35%, 40%, 45%, 50%, 55%, 60%, 65%, or 70% of the height of the club head body 10. In some embodiments, the intersection plane 34 intersects the club head body 10 between approximately 20%-30%, 30%-40%, 40%-50%, 50%-60%, or 60%-70% of the height of the club head body 10 or any other suitable percentage height value in between those percentage height values, and can range from any one of those percentage height values to any other one of those percentage height values.

A clearance angle 36 is formed between the intersection plane 34 and the upper region 30 of the strike face 20. The clearance angle 36 enables enough space for a second upper die 54 and a second lower die 56 to create a cavity 58 in the intermediate club head 10 in a later step. The clearance angle 36 can range between 1° and 89°. In some embodiments, the clearance angle 36 can range between 5° and 35°. In other embodiments, the clearance angle 36 can range between 5°-11°, 9°-18°, and 13°-35°. In other embodiments, the clearance angle 36 can be 5°, 6°, 7°, 8°, 9°, 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, and 35°.

Figure 14:
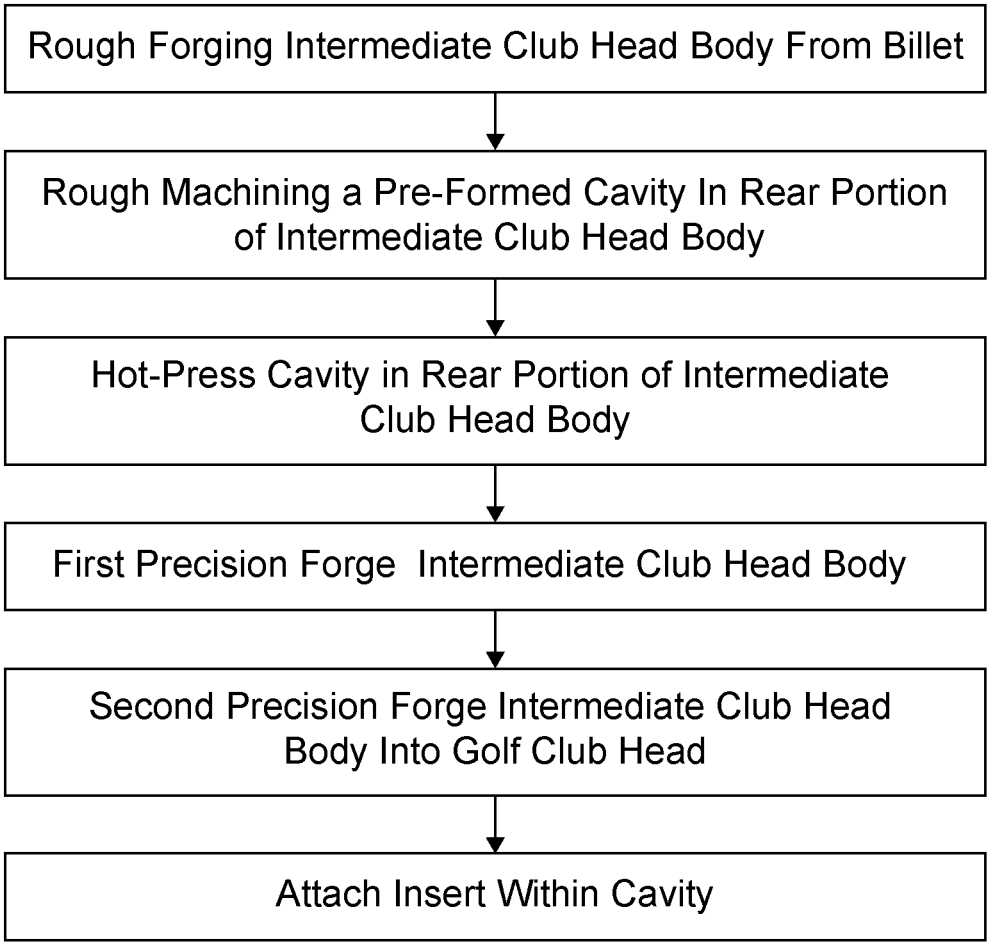
FIG. 14 illustrates a flow diagram representation of one embodiment in which an exemplary golf club head can be manufactured.

In other embodiments, the multi-stage forging process can comprise further intermediate steps than the process illustrated in FIG. 1. The intermediate steps can be implemented to further aid in shaping the cavity and create textures and details on the surface of the to create an aesthetically pleasing appearance. For example, FIG. 14 illustrates another embodiment of the multi-stage forging process comprising six steps: (1) a rough forging stage, in which intermediate club head body 10 is formed from a solid block billet (not shown); (2) a machining stage, in which a cavity is formed with rough dimensions in the intermediate club head body (3) a hot-pressing stage, in which the cavity 58 is expanded and formed into a more final form; (4) a precision forging stage wherein the cavity is finalized; (5) another precision forging stage wherein the textures and details are formed into the club head body; (6) and an insert 110 or filling is placed within the cavity 58 of the golf club head body 80. This multi-stage forging method allows a manufacturer to create a forged golf club head 80 with a deep undercut cavity 58, from a single solid billet. In some embodiments, the multi-stage forging method can comprise a seventh stage (not shown), wherein a shaft and grip are attached to the golf club head body 80, to form a golf club.

The multi-stage forging process illustrated in FIG. 14 is similar to the embodiment of FIG. 1 in many ways. For example, the embodiment of both FIG. 14 and FIG. 1 each comprise a first rough forging step in which an intermediate club head comprising a bent strike face is formed, as described above. Conversely, the multi-stage forging process of FIG. 14 differs from the process illustrated in FIG. 1 in that the process of FIG. 14 comprises an intermediate machining step after the first rough forging step described above.

B. Cavity Machining

In some embodiments, the multi-stage forging process may comprise an additional step of pre-forming the cavity 58 into the intermediate club head body 10. In this second step, the pre-forming of the cavity 58 is accomplished through the use of a rough milling process. The rough milling process removes material along the upper edge 38 in the rear portion 24, creating a pre-formed cavity. The rough milling creates the approximate dimensions of the cavity to assist in the next step of the multi-stage forging process. The pre-formed cavity assists the second upper die 54 in forming the final cavity 58 by removing material from the rear so that there is less material for the second upper die 54 to push out of the cavity 58.

C. Cavity Formation

Figure 3:
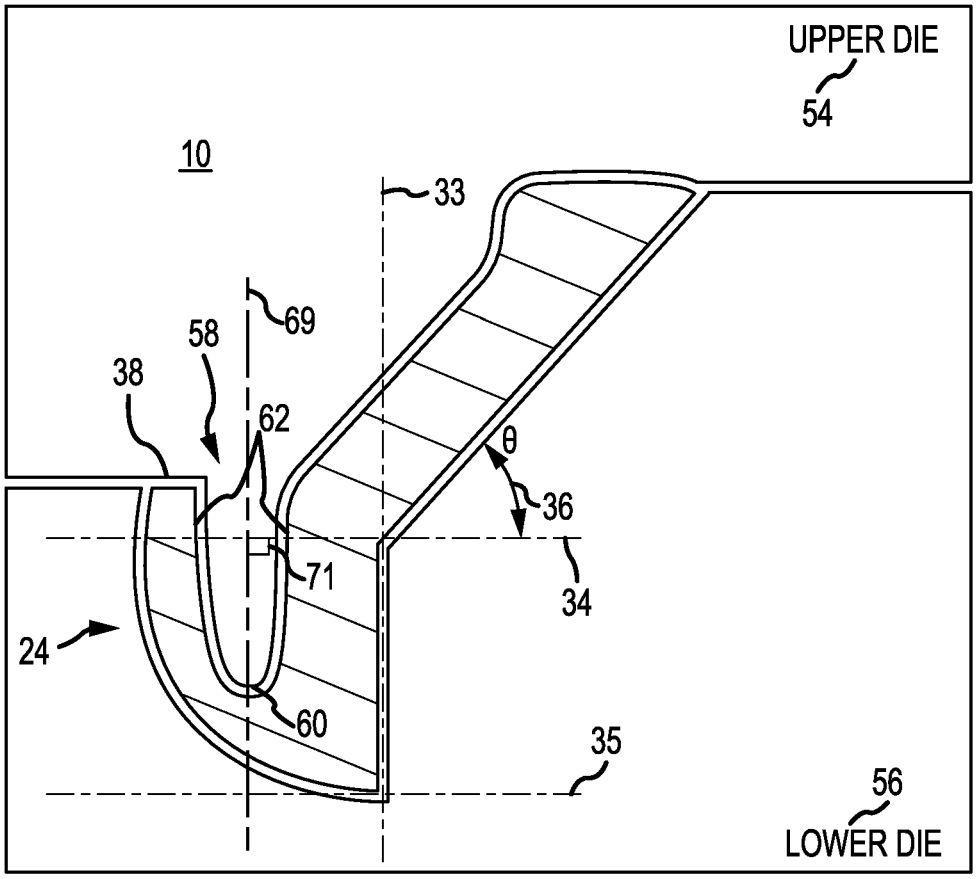
FIG. 3 illustrates a cross-sectional view of a club head during a multi-stage forging process.

Referring to FIG. 3, the next step of the multi-stage forging method is the cavity 58 formation in the intermediate club head body 10. Formation of the cavity 58 from the intermediate club head body 10 is accomplished by one or more of the following processes: hot pressing, machining, milling, drilling, or machine punching. The embodiment in FIG. 3, illustrates the hot-pressing technique. The hot-pressing technique utilizes the second upper die 54 and the second lower die 56 (wherein the second upper die 54 and second lower die 56 are different in shape from the first upper die 12 and first lower die 14 of the rough forging stage) to precisely dimension a cavity 58 generally perpendicular to the upper edge 38 in the rear portion 24 of the intermediate club head body 10. The second upper die 54 comprises a sharp geometry to penetrate through the upper edge 38 of the rear portion 24, while the second lower die 56 holds the intermediate club head 10 at the desired clearance angle 36, thus forming the cavity 58.

In the embodiments of the multi-stage forging method in which the method comprises the second rough machining step described above, the second upper die 54 comprises the precise geometry of the cavity that is then inserted into the pre-formed cavity produced by the previous rough machining step. The pre-formed cavity created in the previous step aids in the cavity formation by requiring less material to be moved or shaped by the hot-pressing step and allows the die to be inserted partially into the pre-formed cavity. In this embodiment in which the intermediate club head comprises a pre-formed cavity, the second upper die 54 need not have sharp geometry to penetrate the rear body because the pre-formed cavity assists the second die to be inserted into rear without needing to penetrate material.

For both methods above, the necessary temperature required to hot press the cavity 58 in the intermediate club head body 10 can range between 700° C. and 1150° C. In order to avoid strain hardening of the metal during deformation, this extreme heat is necessary for the hot-pressing process. If strain hardening occurs, the intermediate club head body 10 will become less malleable, making the cavity 58 harder to form. In some embodiments, the temperature required to hot press the cavity 58 in the intermediate club head body 10 can range between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C., 1100-1125° C., 1125-1150° C. In one embodiment, the temperature required to hot press the cavity 58 in the intermediate club head body 10 can range between 775° C. and 800° C.

Once the intermediate club head body 10 is heated to a desired temperature, the second lower die 56 apply a desired pressure to the intermediate club head body 10 maintaining shape (strike face 20, bent about an intersection plane 34, at a desired clearance angle 36). The cavity 58 is then formed as the second upper die 54 applies a desired pressure and the sharp geometry penetrates through the upper edge 38 and within the rear portion 24. The desired pressure that is applied to the intermediate club head body 10 by the second upper die 54 and the second lower die 56 is between 500 tons and 800 tons (1 ton is equivalent to 2000 pounds force). In some embodiments, the desired pressure of the second upper die 54 and second lower die 56 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the upper die 54 and lower die 56 is between 675 tons and 700 tons. The extreme pressure of the second upper die 54 and second lower die 56, quickly forms the cavity 58 in the intermediate club head body 10, thus maintaining the material and tensile properties of the metallic intermediate club head body 10.

The cavity 58 formed by the methods described above, including hot-pressing, comprises a lower surface 60 and two interior surface walls 62. The cavity 58 further comprises a surface area and a volume, that can provide a surface and region to affix an insert to, in a later step.

Further, the cavity 58 comprises a cavity axis 69. The cavity axis 69 passes through a nadir of the cavity 58 lower surface 60. The cavity axis 69 exactly bisects the cavity 58 and is equidistant from the cavity 58 interior surface walls 68. The cavity 58 can be hot-pressed at an angle 71, wherein the press angle 71 is measured from the cavity axis 69 to the intersection plane 34. The press angle can range between 60° and 90°. In some embodiments, the press angle 71 can range between 60°-65°, 65°-70°, 70°-75°, 75°-80°, and 85°-90° or any other suitable press angle 71 value in between those press angles 71 and can range from any one of those press angles 71 to any other one of those press angles 71. In other embodiments, the press angle 71 can be 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, or 90°. The press angle 71, enables an insert to be affixed within the cavity 58 (in a later step) at a desired angle. Furthermore, the press angle 71 enables a set of iron-type golf club heads with cavities to be formed, via the multi-stage forging method, with identical press angles 71, and/or dissimilar press angles 71.

Further still, the cavity 58 can have a substantially triangular, rectangular, square, semi-circular, parabolic, or trapezoidal cross section. In some embodiments, the cavity 58 can comprise a different cross-section at a toe end of the cavity 58 and the heel end of the cavity 58.

In some embodiments, the cavity 58 can have a volume of approximately 0.8 cc, 1.0 cc, 1.25 cc, 1.5 cc, 1.75 cc, 2.0 cc, 2.25 cc, 2.5 cc, 2.75 cc, 3.0 cc, 3.25 cc, 3.5 cc, 3.75 cc, 4.0 cc, 4.25 cc, 4.5 cc, 4.75 cc, 5.0 cc, 5.25 cc, 5.5 cc, 5.75 cc, 6.0 cc, 6.25 cc, 6.5 cc, 6.75 cc, 7.0 cc, 7.25 cc, 7.5 cc, 7.75 cc, 8.0 cc, 8.25 cc, 8.5 cc, 8.75 cc, 9.0 cc, 9.25 cc, 9.5 cc, 9.75 cc, 10.0 cc, 10.25 cc, 10.5 cc, 10.75 cc, 11.0 cc, 11.25 cc, 11.5 cc, 11.75 cc, 12.0 cc, 12.25 cc, 12.5 cc, 12.75 cc, 13.0 cc, 13.25 cc, 13.5 cc, 13.75 cc, 14.0 cc, 14.25 cc, 14.5 cc, 14.75 cc, 15.0 cc, 15.25 cc, 15.5 cc, 15.75 cc, 16.0 cc, or any other suitable volume value in between those volume values, and can range from any one of those volume values to any other one of those volume values. In one embodiment, the volume of the cavity 58 is 4.25 cc. The volume of the cavity 58 can be substantially similar to the volume of an insert that is affixed within the cavity 58.

In some embodiments, the cavity 58 can have a surface area ranging between approximately 3.00-4.00 cm2, 4.00-5.00 cm2, 5.00-6.00 cm2, 6.00-7.00 cm2, 7.00-8.00 cm2, 8.00-9.00 cm2, 10.00-11.00 cm2, 11.00-12.00 cm2, 12.00-13.00 cm2, 13.00-14.00 cm2, 14.00-15.00 cm2, 15.00-16.00 cm2, 16.00-17.00 cm2, 17.00-18.00 cm2, 18.00-19.00 cm2, 19.00-20.00 cm2, 20.00-21.00 cm2, 21.00-22.00 cm2, 22.00-23.00 cm2, 23.00-24.00 cm2, 24.00-25.00 cm2, 25.00-26.00 cm2, 26.00-27.00 cm2, 27.00-28.00 cm2, 28.00-29.00 cm2, or 29.00-30.00 cm2. In other embodiments, the surface area of the cavity 58 can be any other suitable surface area value in between those surface area values and can range from any one of those surface area values to any other one of those surface area values. The surface area of the cavity 58 can be substantially similar to the surface area of an insert that is affixed within the cavity 58.

In some embodiments, the cavity 58 can have a depth of approximately 0.05 inches (1.27 mm), 0.10 inches (2.54 mm), 0.15 inches (3.81 mm), 0.20 inches (5.08 mm), 0.25 inches (6.35 mm), 0.30 inches (7.62 mm), 0.35 inches (8.89 mm), 0.40 inches (10.16 mm), 0.45 inches (11.43 mm), 0.50 inches (12.7 mm), 0.55 inches (13.97 mm), 0.60 inches (15.24 mm), 0.65 inches (16.51 mm), 0.70 inches (17.78 mm), 0.75 inches (19.05 mm), 0.80 inches (20.32 mm), 0.85 inches (21.59 mm), 0.90 inches (22.86 mm), 0.95 inches (24.13 mm), 1.0 inches (25.4 mm) or any other suitable depth value in between those depth values, and can range from any one of those depth values to any other on of those depth values. The depth of the cavity 58 can be substantially similar to a height of an insert that is affixed within the cavity 58.

Following the cavity 58 formation in the intermediate club head body 10, a final precision forging stage is performed to straighten the clearance angle 36 into a final golf club head.

D. Precision Forging

After the hot-pressing of the cavity 58 into the intermediate club head body 10, the club head body 10 is precision forged, wherein the strike face 20 is bent to a final angle 96, wherein the final angle 96 is formed between the intersection plane 34 and the strike face 20. The final angle 96 is approximately between 88°-92° or 88°, 89°, 90°, 91°, or 92°, thereby aligning the upper region 30 with the lower region 32 of the club heady body 10. The intermediate club head body 10 is therefore forged further into a final golf club head 80.

Figure 4:
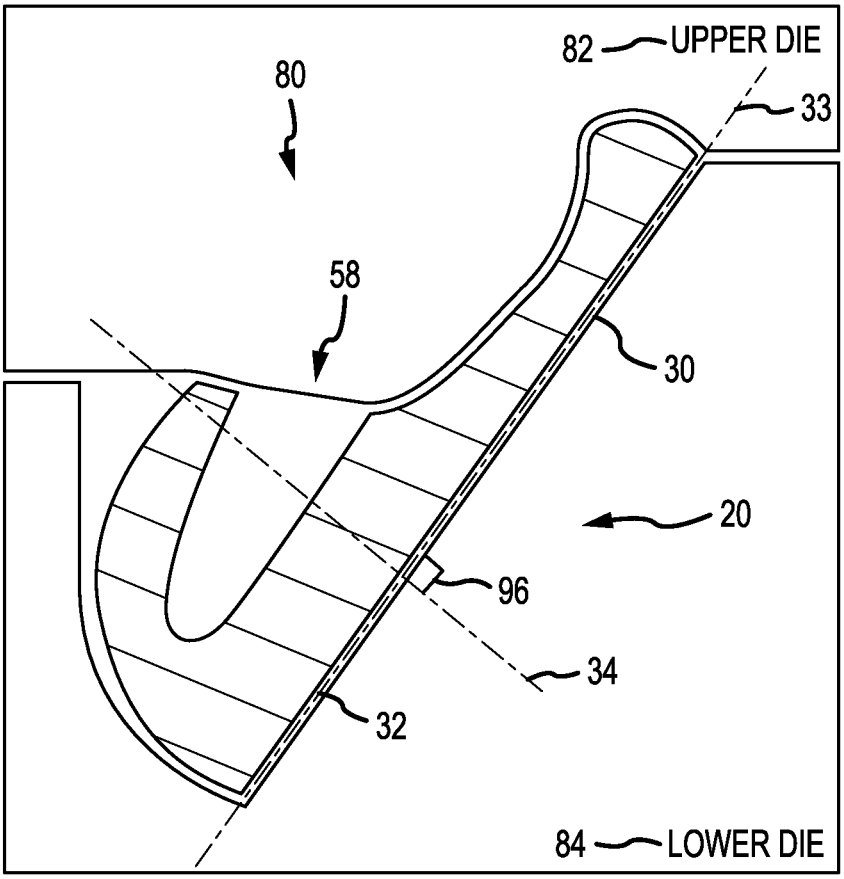
FIG. 4 illustrates a cross-sectional view of a club head during a multi-stage forging process.

Referring to FIG. 4, this precision forging stage comprises a third upper die 82 and a third lower die 84, wherein the third upper die 82 and third lower die 84 are shaped in a desired geometry (wherein the second upper die 54, the second lower die 56, the first upper die 12, and the first lower die 14 are different in shape from the third upper die 82 and third lower die 84). The third upper die 82 and third lower die 84 apply a desired pressure to the intermediate club head body 10, bending the upper portion 30 of the strike face 20 to align with the lower portion 32 of the strike face 20 within the strike plane 33, thus bending the clearance angle 36 to a final angle 96 of approximately 90° to the intersection plane 36. In doing so, the intermediate club head body 10 is forged into a final golf club head 80, as the strike face 20 is now continuously straight and can function for its intended purpose of striking a golf ball.

The intermediate club head body 10, formed from the previous steps, must be heated to a desired temperature to bend the strike face 20 into the strike plane 33 in order to carry out this stage of the method. The intermediate club head body 10 is heated to a desired temperature between 700° C. and 1100° C. In some embodiments, the desired temperature of the intermediate club head body 10 for precision forging is between 700-725° C., 725-750° C., 750-775° C., 775-800° C., 800-825° C., 825-850° C., 850-875° C., 875-900° C., 900-925° C., 925-950° C., 950-975° C., 975-1000° C., 1000-1025° C., 1025-1050° C., 1050-1075° C., 1075-1100° C. In one embodiment, the desired temperature of the intermediate club head body 10 for rough forging is between 800-825° C.

Once the intermediate club head body 10 is heated to a desired temperature, the lower die 84 maintains the shape of the cavity and lower portion 32, while the third upper die 82 presses against the back wall 22. The third upper die 82 forces the upper portion 30 of the intermediate club head body 10 flush against the third lower die 84, thus aligning the upper portion 30 with the lower portion, and therefore bending the clearance angle 36 to approximately 90° to the intersection plane 36. The desired pressure that is applied to the intermediate club head body 10 by the third upper die 82 and the third lower die 84 is between 500 tons and 800 tons (1 ton is equivalent to 2000 pounds force). In some embodiments, the desired pressure of the third upper die 82 and the third lower die 84 is between 500-525 tons, 525-550 tons, 550-575 tons, 575-600 tons, 600-625 tons, 625-650 tons, 650-675 tons, 675-700 tons, 700-725 tons, 725-750 tons, 750-775 tons, and 775-800 tons. In some embodiments, the desired pressure of the third upper die 82 and the third lower die 84 is between 675 tons and 700 tons. The extreme pressure of the upper die 82 and the third lower die 84, maintains the form of the lower portion 32 and the cavity 58, while pressing the upper region 30, in line with the lower region 32, and thus into a functioning strike face 20. The strike face is then removed from the third upper die 82 and third lower die 84, and set to cool in a room temperature environment, until it is safe to the touch.

In some embodiments, a core piece may be placed into the cavity prior to the precision forging step. The core piece is placed inside the cavity to prevent deformation during the precision forging step. Due to extreme pressures from the precision forging, in some cases the cavity geometry can be compromised by expanding material being pushed into the cavity. The core piece acts as a placeholder to prevent any unwanted deformation in the cavity during the precision forging step. The core piece will aid in maintaining the precise geometry and tolerances of the cavity 58. In some embodiments of the multi-stage forging process, the process can further comprise a second precision forging method.

E. Second Precision Forging

Following the first precision forging step described above, the multi-stage forging process can comprise an additional precision forging step, as illustrated in FIG. 14. The second precision forging step can be used to create the final dimensions of the overall club head body while also forming any desired aesthetic designs and features into the club head body. For example, the second precision forging step can form details into the back wall 22. Details can include any small grooves, channels, fillets, chamfers, protrusions, or any other small changes to geometry that combine to create a visually appealing club head.

The second precision forging step can comprise a core piece placed into the cavity, similar to the first precision forging step described above. As mentioned above, the core piece aids in preventing deformation of the cavity during the second precision forging step so that the cavity can maintain the precise final geometries and tolerances.

After the second precision forging step, the golf club head may comprise excess material around the perimeter of the club head (i.e., where the upper and lower die meet) from the series of forging steps. A final finishing step may be used to remove any excess material from the perimeter. A machining, cutting, pressing, drilling, or other method may be used to remove this material.

F. Insert Placement

Figure 5:
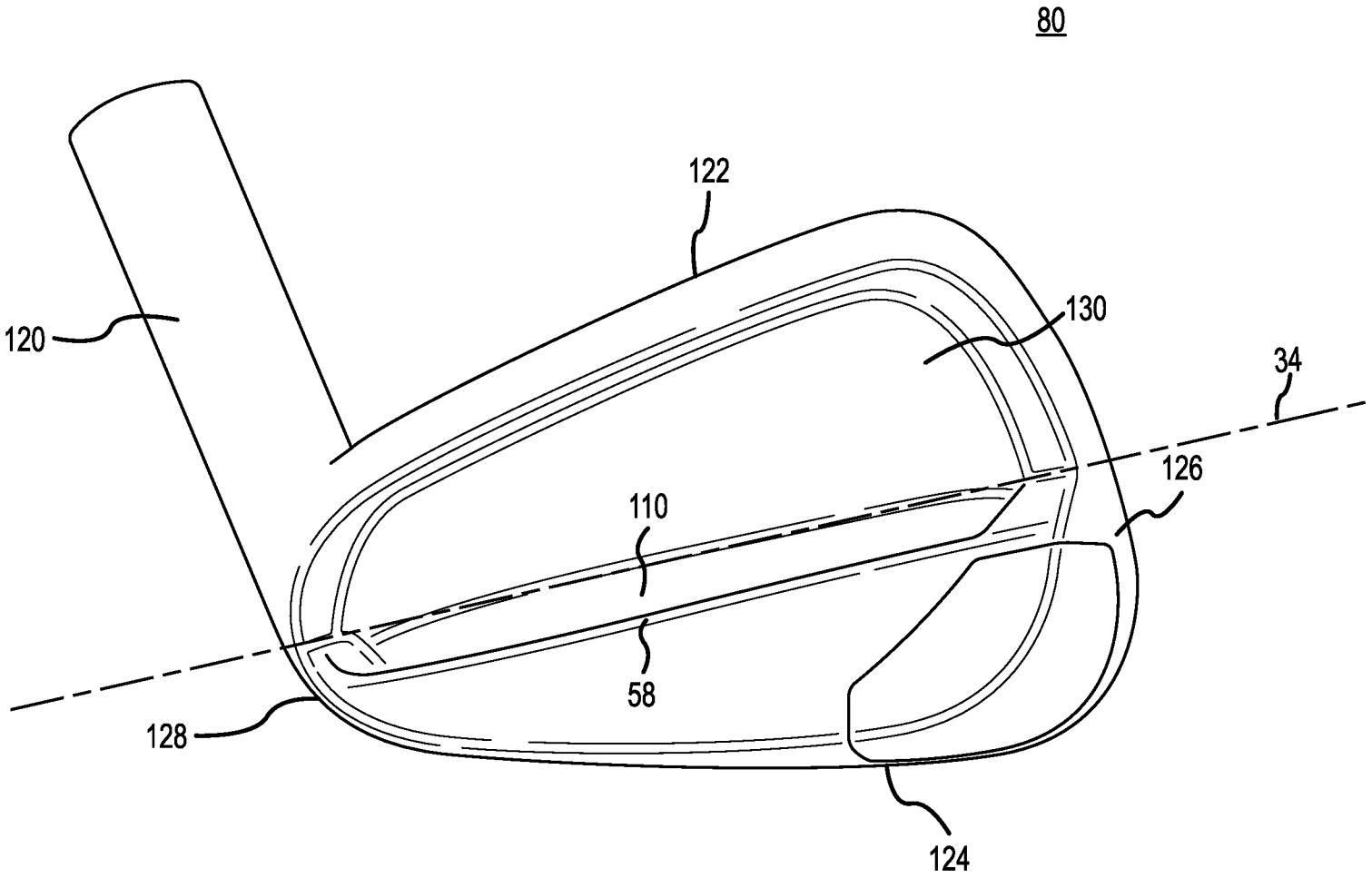
FIG. 5 illustrates a manufactured golf club head with cavity.

Referencing FIG. 5, following the three stages of forging the final golf club head 80, an insert 110 can be affixed to the interior surface wall 62 and lower surface 60 of the cavity 58. In some embodiments, nothing is placed with the cavity 58. The insert 110 is different than the core piece described above in that the insert is made of a light weight material and is designed to fit within the final golf club head. The core piece is a hard and solid piece designed to withstand the pressures of forging that is not present in the final golf club head. The insert 110 can be secured into the cavity 58 via adhesion, press-fitting, mechanical fastening, or any other suitable methods of securing the insert 110. The insert 110 can be made of one or more elastomers. For example, the insert 110 can be made of nonferrous thermoplastic urethane, thermoplastic elastomeric polymer(s), hybrid plastics with a mix of ferrous particles or other alloy ferrous particles mixed into polyurethane or other elastomeric polymers. In other embodiments, the insert 110 can be a metal such as aluminum, steel, tungsten, forms of beads in polymer, powder metal in a suspension cured in a polymer, or other suitable metals, such as when the insert 110 is sintered or machined.

Further, the insert 110 can occupy the entire cavity 58 or a percentage of the cavity 58. The percentage of the cavity 58 that is occupied can range between 5% and 100%. In some embodiments, the percentage of the cavity 58 that is occupied can range between 5%-15%, 15% 25%, 25%-35%, 35%-45%, 45%-55%, 55%-65%, 65%-75%-85%, 85%-95%, 95%-100%. In one embodiment, the percentage of the cavity 58 that is occupied ranges between 95% 100%.

In many embodiments, the insert 110 can have a weight that advantageously can be configured to reinforce the strike face 20, to beneficially minimize undesirable impact vibration, and/or to establish or adjust the golf club swing weight during assembly. For example, the insert 110 can have a mass of approximately 1.0 g to approximately 100 g. For example, tuning element 150 can have a mass of approximately 1.0 g, 2.0 g, 3.0 g, 4.0 g, 5.0 g, 6.0 g, 7.0 g, 8.0 g, 9.0 g, 10.0 g, 11.0 g, 12.0 g, 13.0 g, 14.0 g, 15.0 g, 16.0 g, 17.0 g, 18.0 g, 19.0 g, 20.0 g, 21.0 g, 22.0 g, 23.0 g, 24.0 g, 25.0 g, 26.0 g, 27.0 g, 28.0 g, 29.0 g, 30.0 g, 35.0 g, 40.0 g, 45.0 g, 50.0 g, 55.0 g, 60.0 g, 65.0 g, 70.0 g, 75.0 g, 80.0 g, 85.0 g, 90.0 g, 95.0 g, 100.0 g, or any other suitable mass in between those mass values, and can range from any one of those mass values to any other one of those distance values. For example, in some embodiments, the insert 110 can have a mass of approximately 1.0 g to approximately 30.0 g.

In several embodiments, the insert 110 can have a density of approximately 1.0 g/cc to approximately 20.0 g/cc. For example, the insert 110 can have a density of approximately 1.0 g/cc, 1.5 g/cc, 2.0 g/cc, 2.5 g/cc, 3.0 g/cc, 3.5 g/cc, 4.0 g/cc, 4.5 g/cc, 5.0 g/cc, 5.5 g/cc, 6.0 g/cc, 6.5 g/cc, 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, 20.0 g/cc, or any other suitable density value in between those density values, and can range from any one of those density values to any other one of those density values.

In reference to FIG. 5, the final golf club 80, formed by the aforementioned manufacturing process, is a forged iron type golf club head with a cavity 58. The final golf club 80 comprises: a hosel 120, a top rail 122, a sole 124, a toe region 126, a heel region 128, a rear 130, a strike face 20 (not shown), a cavity 58, and an insert 110.

G. Manufactured Golf Club Head

The multi-stage forging processes described above produces a forged iron type club head with a rear cavity and an elastomeric insert. The manufactured forged iron club head can have the mass properties similar to that of casted cavity back club heads due to the additional mass savings of the cavity and elastomeric insert. The mass savings allows for discretionary mass to be placed further to the perimeter and lower in the club head to increase the moment of inertia and lower center of gravity. The manufactured forged iron club head can further comprise geometry and grain structure of a traditional forged iron. The manufactured forged iron club head can have the appearance and solid feel that is characteristic of traditional forged irons. As such, the manufactured forged iron combines the mass property benefits of casted cavity back club head with the look and feel of traditional forged irons. The manufactured forged iron club head can comprise various geometries describe in further detail below. The various geometries can be achieved by changing the geometries of the forging dies described above.

Embodiment 1

A first exemplary embodiment of a manufactured forged iron made through the use of the multi-stage forging process is illustrated in FIGS. 6-9. In this embodiment, the forged iron club head comprises a deep (in at least one embodiment approximately 15 mm) and narrow (in at least one embodiment approximately 2.5 mm) forged cavity 258. This forged cavity 258 is (but not limited to) approximately 12 mm deeper and 5 mm narrower than a second embodiment, to be introduced later. The deep and narrow cavity is accomplished by pressing additional material into the sole 224 to create a large cavity. This additional material moved in the forging process creates a larger sole. The deep and narrow cavity of the illustrated embodiment can improve ball speed by placing the cavity close to the strike face. The cavity projects onto a greater area of the surface of the strike face, increasing the face flexure and trampoline affect. The cavity also moves material and weight from the center of the club head towards the sole, which lowers the CG in some embodiments by (but not limited to) approximately 1.3 mm and increases the Iyy by (but not limited to) 200 g*cm$^2$ over a traditionally forged iron.

The forged iron club head 200 comprises a top rail 222, a sole 224 opposite the top rail 222, a hosel 220, a toe region 226, a heel region 228 opposite the toe region 226, a rear 230, a strike face 202, a cavity 258, and an insert 210. The club head 200 further comprises an upper rear region 240 and a lower rear region 250. The upper rear region 240 extends into the toe region 226 and heel region 228 and from the top rail 222 to downward to the lower rear region 250 such that the upper rear region 240 terminates at the topmost portion of the lower rear region 250. The lower rear region 250 extends into the toe region 226 and heel region 228 and from the sole 224 upwards to the upper rear region 240 such that the lower rear region terminates at the bottom of the upper rear region 240. The upper rear region 240 comprises perimeter weighting formed defined by an area of increased thickness such that material extends rearwardly from the strike face 202. The lower rear region 250 is an area of increased thickness. The lower rear region 250 further comprises the forged cavity 258. The forged cavity extends in an approximately top rail to sole direction.

The forged cavity 258 comprises a front wall 262, a rear wall 252, a bottom wall 272, a toe wall (not shown), and heel wall 256. The front wall 262 and rear wall 252 extend in a top rail-to-sole and a heel-to-toe direction. The front wall 252 is located proximate the strike face 202 and the rear wall 252 is located rearwardly of the front wall 262. The heel wall 256 and toe wall connect the front wall 262 to the back wall 252 in the heel region 228 and toe region 226, respectively. The front wall 262, back wall 252, heel wall, 256, and toe wall define the forged cavity 258.

The forged cavity 258 further comprises a width 270 and a depth 260. The width 270 is measured from the front wall 262 to the back wall 252, perpendicular to the strike face 202. In most embodiments the width 270 is tapered such that the width 270 at the top of the exposed cavity 258 is greater than the width 270 at the bottom of the cavity 258. The tapered width 270 allows for the tool to be removed during the forging process. In some embodiments, the width 270 can range from 1.2 mm to 12.7 mm at either the top or bottom of the cavity 258. For example, the width 270 at the top of the cavity 258 can range from 1.2 mm to 12.7 mm and the width 270 at the bottom of the cavity can range from 1.2 mm to 10.2 mm. In the illustrated embodiment, the width 270 at the top of the cavity 258 is approximately 3.1 mm and the width at the bottom of the cavity 258 is approximately 2.29 mm in at least one embodiment. The width of the cavity is (but not limited to) approximately 5 mm narrower at the top of the cavity and approximately 4 mm narrower at the bottom of the cavity compared to an exemplary embodiment 2, which is introduced later.

The depth 260 of the cavity 258 is measured in a generally top to bottom direction and parallel to the strike face 202 (i.e., top rail 222 to sole 224 direction). The depth 260 is measured from the topmost portion of the rear wall 252 to the bottom wall 272 of the forged cavity 258. The depth 260 of the cavity 258 can range from 1.9 mm to 20 mm. For example, the depth 260 can range from 1.9 mm to 5 mm, 5 mm to 10 mm, 10 mm to 15 mm, or 15 mm to 20 mm. In the first embodiments, the depth 260 of the cavity 258 is approximately 15 mm. In at least one embodiment, the depth of the cavity is (but not limited to) approximately 12 mm deeper than an exemplary embodiment 2, which is introduced later.

The forged iron 200 further comprises a top rail thickness 232. The top rail thickness 232 is the thickness of the top rail 222 measured in a direction perpendicular from the strike face 202 to the rear 230. In some embodiments, the forged cavity back iron can have a top rail thickness 232 ranging from about 4.8 mm to 8.3 mm. For example, the top rail thickness 232 can range from about 4.8 mm to 5 mm, 5 mm to 5.2 mm, 5.2 mm to 5.4 mm, 5.4 mm to 5.6 mm 5.6 mm to 5.8 mm, 5.8 mm to 6 mm, 6 mm to 6.5 mm, 6.5 mm to 7 mm, 7 mm to 7.5 mm, 7.5 mm to 8 mm, or 8 mm to 8.3 mm. The forged cavity back iron can have a top rail thickness 232 of about 4.8 mm, 5 mm, 5.2 mm, 5.4 mm, 5.6 mm, 5.8 mm, 6 mm, 6.2 mm, 6.4 mm, 6.6 mm, 6.8 mm, 7 mm, 7.2 mm, 7.4 mm, 7.6 mm, 7.8 mm, 8 mm, or 8.3 mm. The forged cavity back iron in the illustrated embodiment has a top rail thickness 232 of about 6.6 mm.

The forged iron 200 further comprises a blade length 234. The blade length 234 is the length of the sole 224 measured from the heel most end to the toe most end. In some embodiments, the forged cavity back iron can have a blade length 234 ranging from 63 mm to 73 mm. For example, the blade length 234 can range from 63 mm to 65 mm, 65 mm to 67 mm, 67 mm to 69 mm, 69 mm to 71 mm, or 71 mm to 73 mm. The forged cavity back iron can have a blade length 234 of 63 mm, 64 mm, 65 mm, 66 mm, 67 mm, 68 mm, 69 mm, 70 mm, 71 mm, 72 mm, or 73 mm. The forged cavity back iron in the illustrated embodiment has a blade length 234 of about 70 mm.

Figure 6:
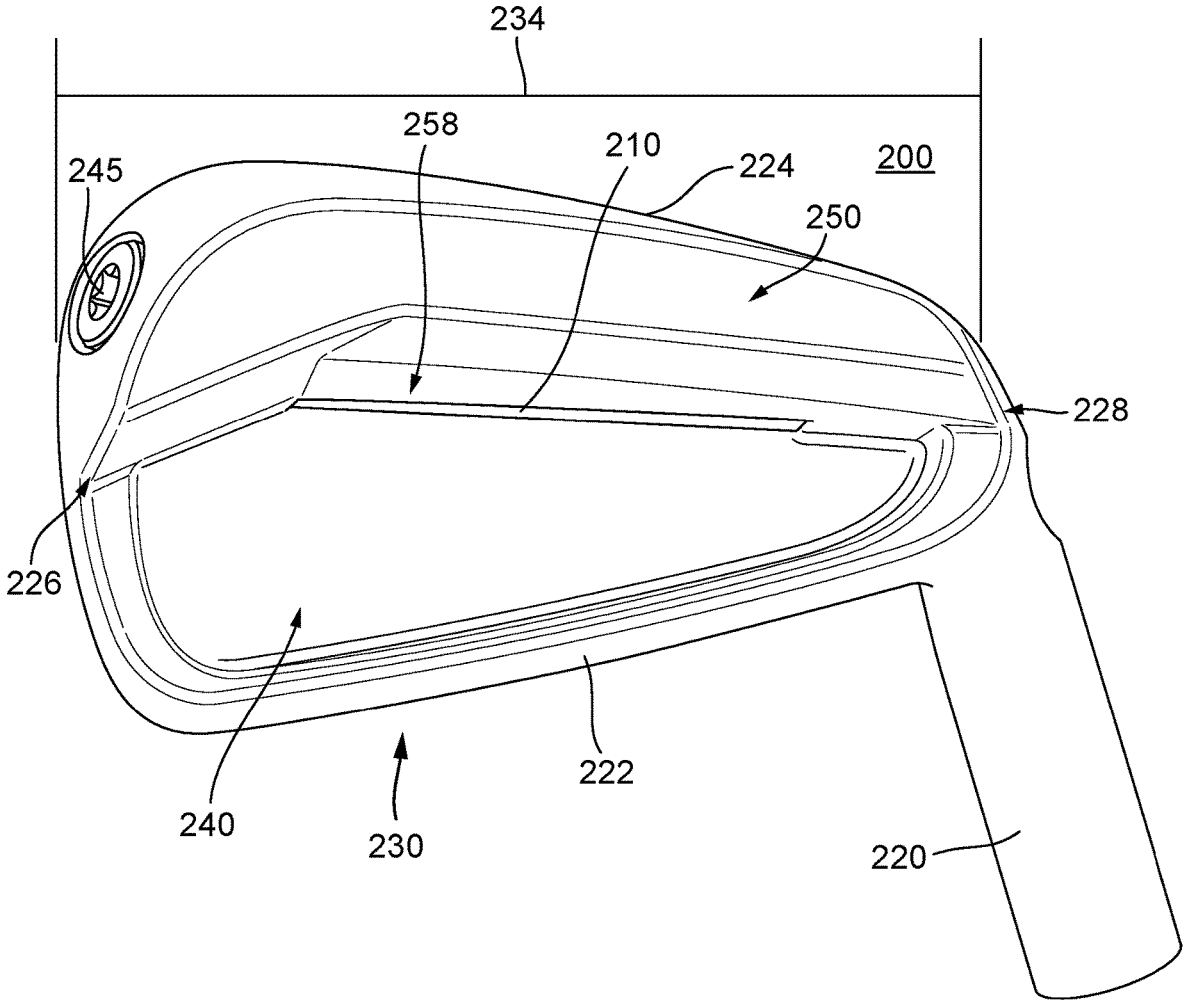
FIG. 6 illustrates a rear perspective view of a manufactured golf club head with a cavity according to a first embodiment.
Figure 7:
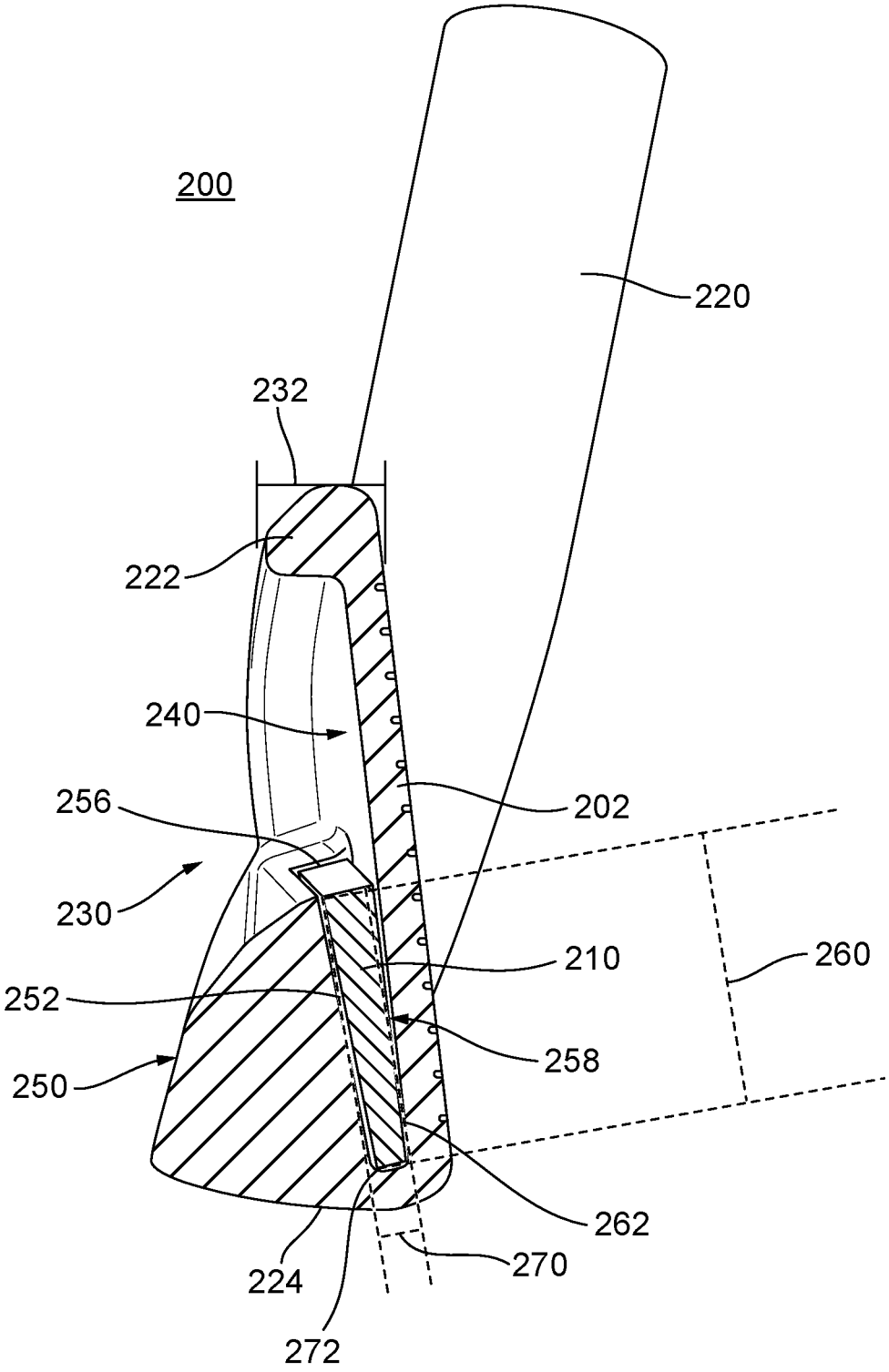
FIG. 7 illustrates a cross-sectional view of the golf club head of FIG. 6.
Figure 8:
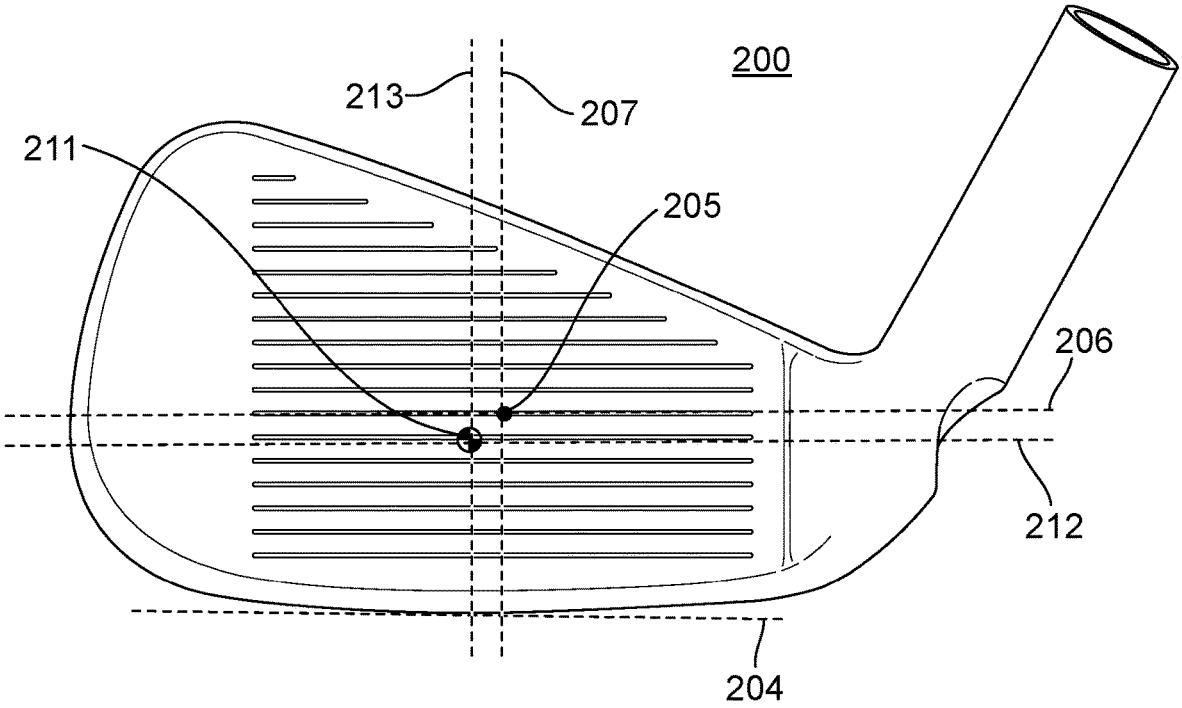
FIG. 8 illustrates a front view of the golf club head of FIG. 6.
Figure 9:
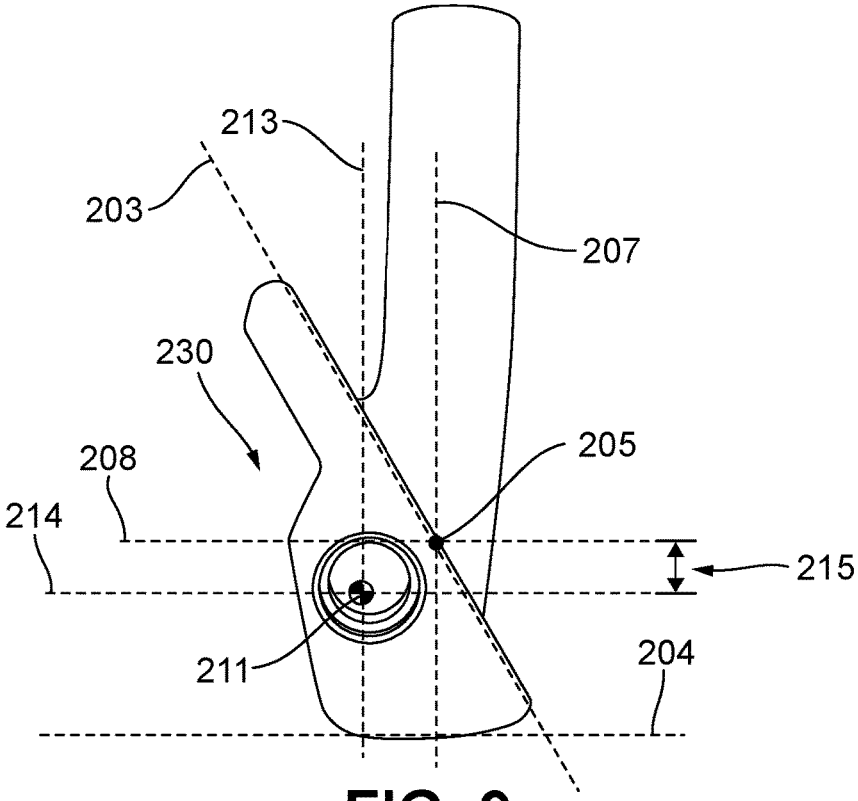
FIG. 9 illustrates a toe side view of the golf club head f FIG. 6.

In the first embodiment illustrated in FIGS. 6 and 7, the forged iron 200 further comprises a toe screw weight 245. In other embodiments, the forged iron 200 does not comprise a toe screw weight 245. In the embodiments which comprise a toe screw weight 245, the toe screw weight 245 may have a mass ranging from 1 gram to 20 grams. For example, the toe screw weight 245 may have a mass of about 1 gram, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, or 20 grams. Further, the toe portion of the club head 200 comprises a thicker portion that is angled from the sole 224 to the top rail 222. This thickness provides more mass to the perimeter of the club head 200 and improves the MOI of the golf club head, when compared to a traditionally forged iron head.

The club head 200 further comprises a coordinate system similar to the coordinate system defined above. The club head 200 defines a loft plane 203 tangent to the face center 205 of the striking surface 202. The club head 200 defines a ground plane 204 tangent to the sole 224 when the club head 200 is at an address position. The face center 205 of the striking surface 202 defines an origin for the coordinate system having an x-axis 206, a y-axis 207, and a z-axis 208. The x-axis 206 is a horizontal axis that extends through the face center 205 in a direction extending from near the heel 228 to near the toe 226, parallel to the ground plane 204. The y-axis 207 is a vertical axis that extends through the face center 205 in a direction extending from near the sole 224 to near the top rail 222, perpendicular to the ground plane 204. The y-axis 207 is perpendicular to the x-axis 206. The z-axis 208 is a horizontal axis that extends through the face center 205 in a direction extending from the strike face 202 to the rear 230, parallel to the ground plane 204. The z-axis 208 is perpendicular to the x-axis 206 and the y-axis 207. The x-axis 206 extends in a positive direction toward the heel 228. The y-axis 207 extends in a positive direction toward the top rail 222. The z-axis 208 extends in a positive direction toward the rear 230.

The club head further comprises a center of gravity (CG) 211. In many embodiments, the CG 211 is located within the coordinate system defined above. The CG 211 can have a location on the x-axis 206, the y-axis 207, and the z-axis 208. The CG 211 further defines an origin of coordinate system having a X'-axis 212, a Y'-axis 213, and a Z'-axis 214. The X'-axis 212 extends through the CG 211 from near the heel 228 to near the toe 226. The Y'-axis 213 extends through the CG 211 from near the top rail 222 to near the sole 224, the Y'-axis 213 is perpendicular to the X'-axis 212. The Z'-axis 214 extends through the CG 211 from near the strike face 202 to near the rear 230, perpendicular to both the X'-axis 212 and the Y'-axis 213.

The CG x-axis 212 is parallel to the x-axis 206; the CG y-axis 213 is parallel to the y-axis 207; the CG z-axis 214 is parallel to the z-axis 208.

The club head 200 further comprises a moment of inertia Iyy about the CG y-axis 213 (i.e. heel-to-toe moment of inertia). In some embodiments, the forged cavity back iron 200 can comprise an Iyy ranging from 2000 $g*cm^2$ to 2750 $g*cm^2$. For example, in some embodiments the Iyy can be 2000 $g*cm^2$, 2050 $g*cm^2$, 2100 $g*cm^2$, 2150 $g*cm^2$, 2200 $g*cm^2$, 2250 $g*cm^2$, 2300 $g*cm^2$, 2350 $g*cm^2$, 2400 $g*cm^2$, 2450 $g*cm^2$, 2500 $g*cm^2$, 2550 $g*cm^2$, 2600 $g*cm^2$, 2650 $g*cm^2$, 2700 $g*cm^2$, or 2750 $g*cm^2$. In the illustrated embodiment the forged cavity back iron 200 has an Iyy of 2323 $g*cm^2$.

The forged cavity back iron 200 further comprises a CG location measured along the y-axis 207 (CGy 215). In some embodiments, the forged cavity back iron 200 can comprise a CGy 215 ranging from −3 mm to −4.5 mm. For example, in some embodiments, the CGy can range from −3 mm to −3.25 mm, −3.25 mm to −3.5 mm, −3.5 mm to −3.75 mm, −3.75 mm to −4 mm, −4 mm to −4.5 mm. In some embodiments the CGy 215 can be −3 mm, −3.1 mm, −3.2 mm, −3.3 mm, −3.4 mm, −3.5 mm, −3.6 mm, −3.7 mm, −3.8 mm, −3.9 mm, −4.0 mm, −4.1 mm, −4.2 mm, −4.3 mm, −4.4 mm, or −4.5 mm. In an exemplary embodiment the forged cavity back iron 200 has a CGy 215 of (but not limited to) −3.88 mm, which is lower than a traditionally forged iron because of the deep cavity.

The manufactured forged cavity back iron 200 created via the multi-stage forging method disclosed herein provides the ability to create a rear cavity in a forged iron which provides the benefits of forging such as tighter grain structure and ease of manufacturing while also providing the benefits of a cavity back iron such as lower CG, higher MOI, and improved sound and feel. Furthermore, in the specific embodiment described above, the forged cavity back iron 200 comprises a deeper and narrower forged cavity 258 to improve face flexure and promote more bending of the strike face upon impact with the golf ball. In other embodiments, the forged cavity back iron can comprise other geometries to alter certain characteristics of the club head to achieve desired performance.

Embodiment 2

Figure 10:
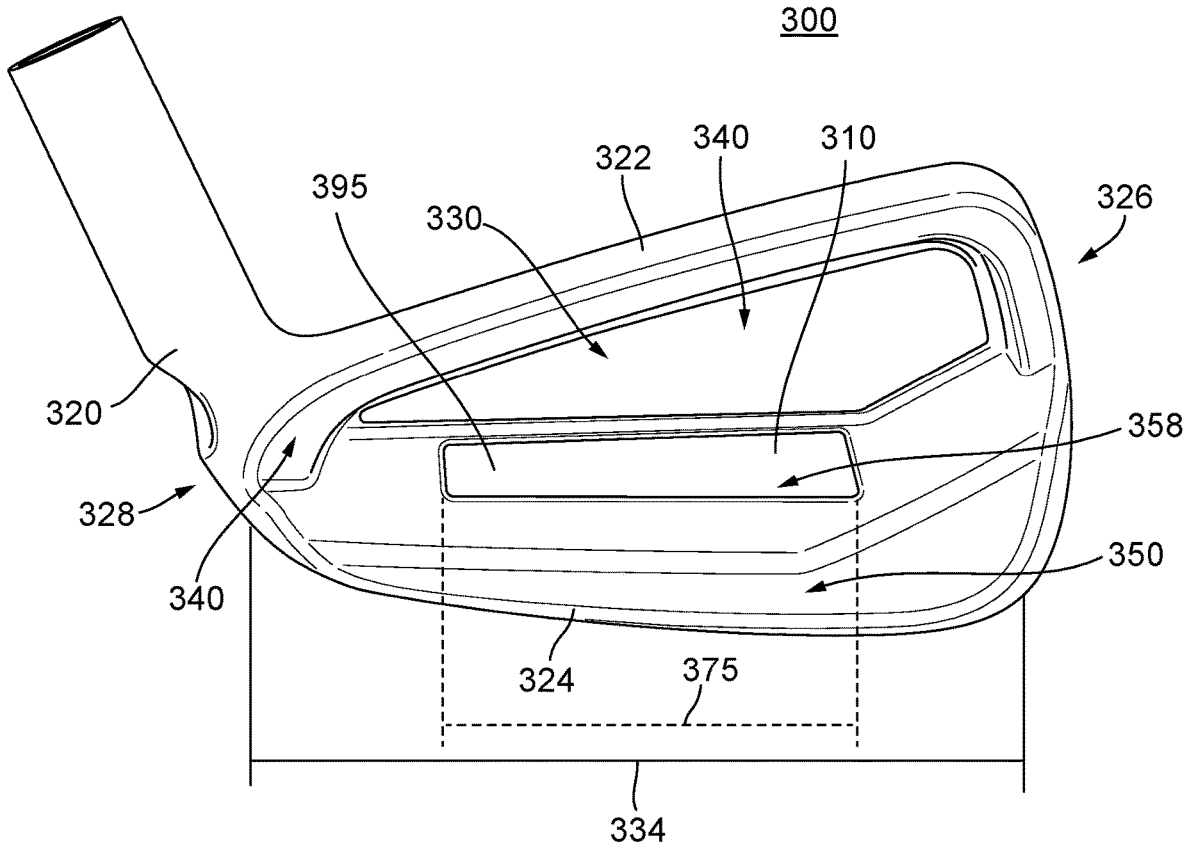
FIG. 10 illustrates a rear view of a manufactured golf club head with a cavity according to a second embodiment.
Figure 11:
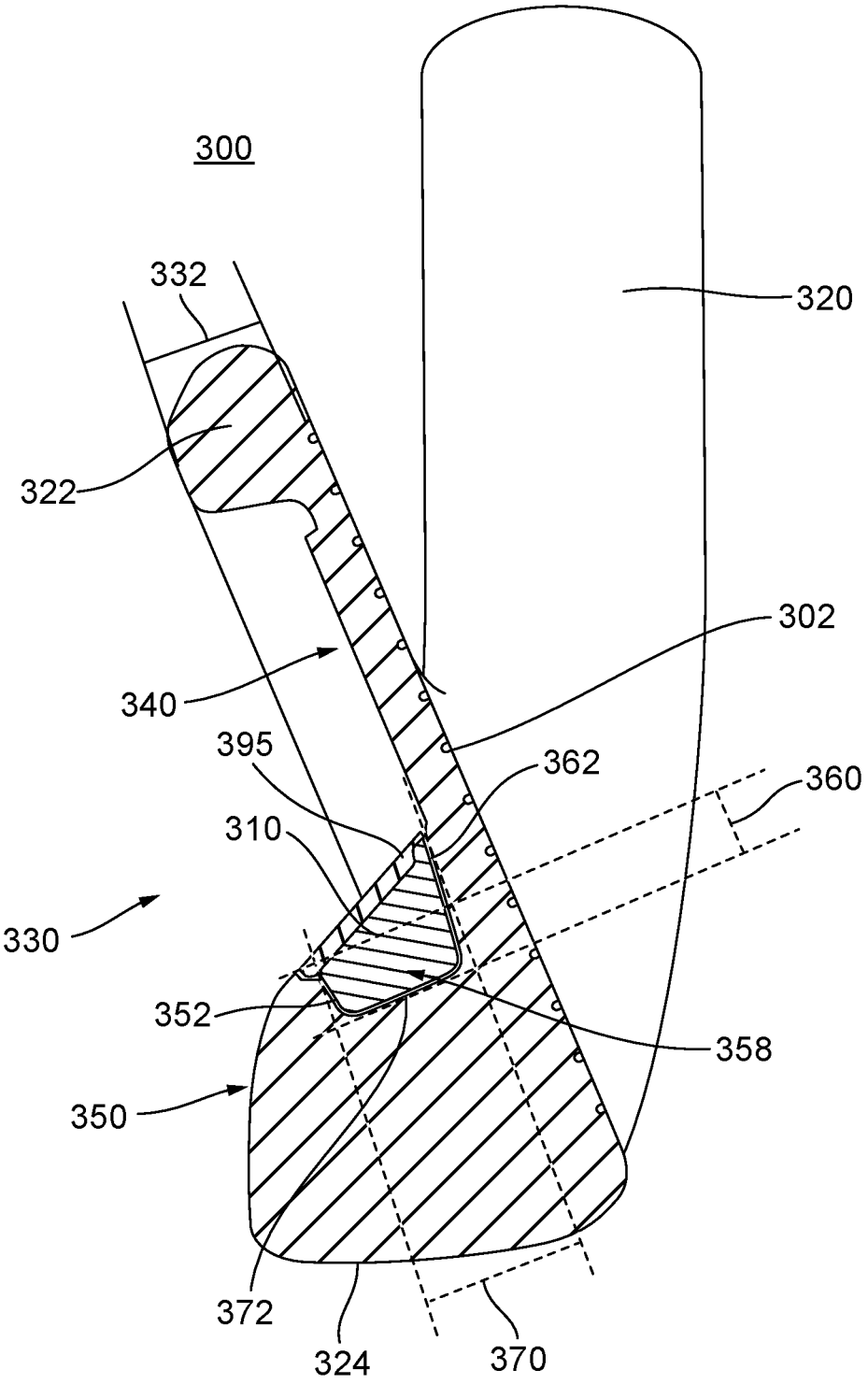
FIG. 11 illustrates a cross-sectional view of the golf club head of FIG. 10.
Figure 12:
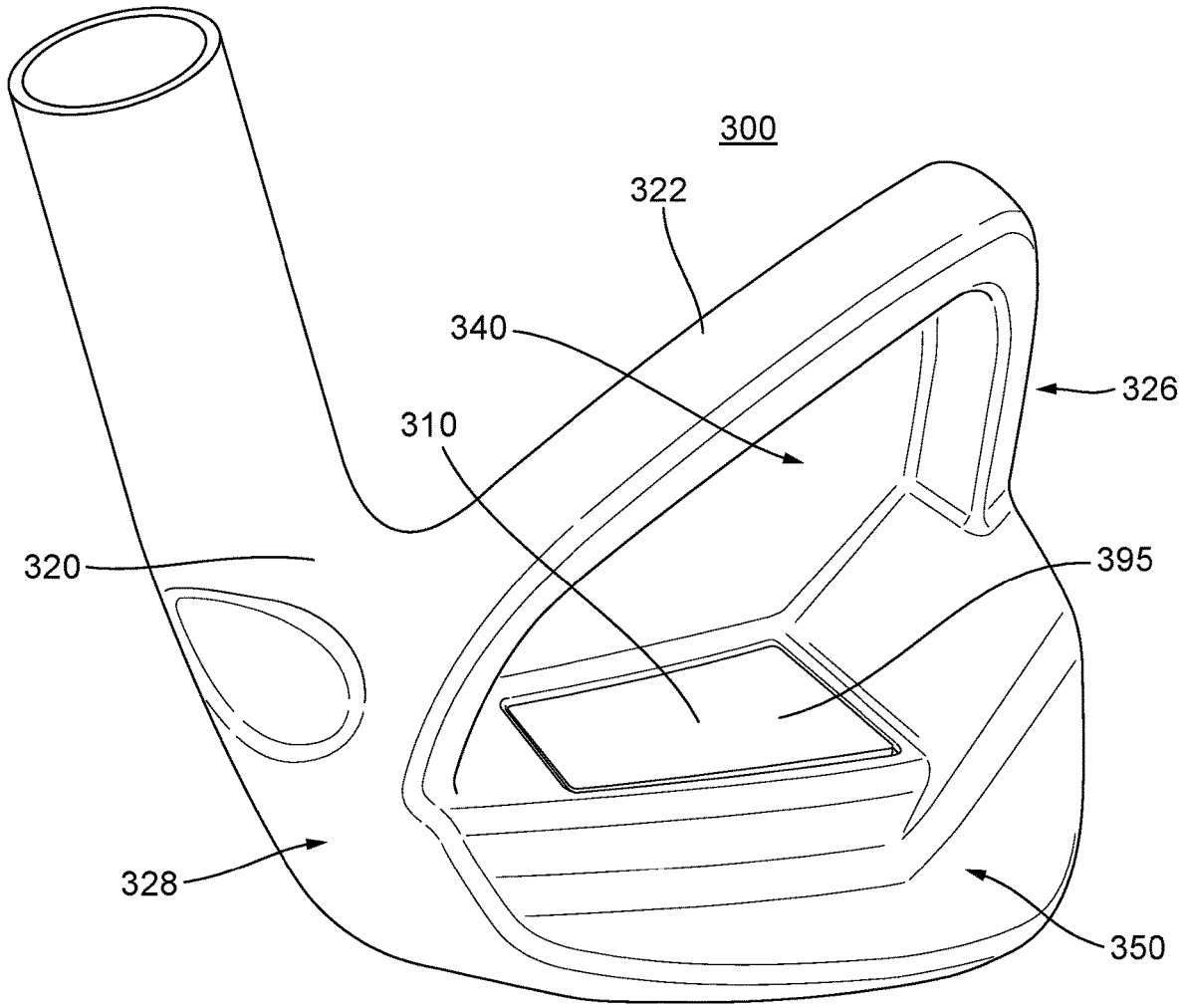
FIG. 12 illustrates a rear perspective view of the golf club head of FIG. 10.

FIGS. 10-12 illustrate a second exemplary embodiment of a forged cavity back iron club head 300 made according to the multi-stage forging process described herein. In this embodiment, the forged cavity back iron club head 300 comprises a rear forged cavity formed via the multi-stage forging process as described above. The forging of a rear cavity removes heavy club head material from the center region of the club head and replaces it with lighter material. This redistributes the mass to the perimeter regions and the sole region of the clubhead to increase the clubhead moment of inertia and lower the center of gravity.

The second embodiment of the forged cavity back iron club head 300 is similar to the first embodiment club head 200 described above in that the forged cavity back iron 300 comprises a forged cavity 358 in the rear of the club head. The club head 300 is different than the club head 200 in that the rear cavity 358 comprises different geometries than the rear cavity 258 to achieve desired mass properties. Specifically, in an exemplary embodiment, not dispositive of all embodiments, the rear cavity 358 can be shallower by about 12 mm and wider by about 5 mm. The shallower and wider cavity 358 is easier to manufacture than the rear cavity 258, while still providing sufficient mass savings which can be allocated to the sole region to lower the center of gravity of the clubhead.

The golf club head 300 comprises a top rail 322, a sole 324 opposite the top rail 322, a hosel 320, a toe region 326, a heel region 328 opposite the toe region 326, a rear 330, a strike face 302, a cavity 358, and an insert 310. The club head 300 further comprises an upper rear region 340 and a lower rear region 350. The upper rear region 340 extends into the toe region 326 and heel region 328 and from the top rail 322 to downward to the lower rear region 350 such that the upper rear region 340 terminates at the topmost portion of the lower rear region 350. The lower rear region 350 extends into the toe region 326 and heel region 328 and from the sole 324 upwards to the upper rear region 340 such that the lower rear region terminates at the bottom of the upper rear region 340. The upper rear region 340 comprises perimeter weighting formed defined by an area of increased thickness such that material extends rearwardly from the strike face 302. The lower rear region 350 is an area of increased thickness. The lower rear region 350 further comprises the forged cavity 358.

The forged cavity 358 comprises a width 370, a depth 360, and a length 375. The width 370 is measured in a generally front to back direction (i.e., away from the strike face 302 towards the rear 330) from the front wall 362 to the back wall 352. In most embodiments, the width 370 is tapered such that the width 370 at the top of the exposed cavity 358 is greater than the width as the bottom of the cavity 358. The tapered width 358 allows for the tool to be removed during the forging process. In some embodiments, the width 370 can range from 1.25 mm to 19 mm. For example, in the illustrated embodiment, the width 370 at the top of the cavity 358 is approximately 8 mm and the width 370 at the bottom of the cavity is approximately 6.42 mm.

The depth 360 of the cavity 358 is measured in a generally top to bottom direction and parallel to the strike face 302 (i.e., top rail 322 to sole 324 direction). The depth 360 is measured from the top of the rear wall 352 to the bottom wall 372. In some embodiments, the depth 360 can range from 2.2 mm to 38 mm. In the second embodiment, the depth 360 of the cavity 358 is approximately 3 mm.

The length 375 of the cavity 358 is measured in a generally heel to toe direction from the heel wall of the cavity to the toe wall of the cavity. In some embodiments, the length 375 of the cavity can range from approximately 19 mm to 70 mm. For example, in some embodiments, the length 375 of the cavity can range from approximately 19 mm to 25 mm, 25 mm to 35 mm, 35 mm to 45 mm, 45 mm to 50 mm, 50 mm to 55 mm, 55 mm to 60 mm, 60 mm to 65 mm, or 65 mm to 70 mm. In the illustrated embodiment, the length is approximately 43 mm.

The insert 310 of the forged iron comprises an exposed surface 395. The exposed surface 395 is the surface of the insert 310 that can be seen from the exterior of the golf club head. In some embodiments, the area of the exposed surface 395 can range from 60 $mm^2$ to 640 $mm^2$. In the second embodiment in FIGS. 10-12, the area of the exposed surface 395 is approximately 342 $mm^2$.

The forged cavity back iron further comprises a top rail thickness 332. The top rail thickness 332 is the thickness of the top rail 322 measured in a direction perpendicular from the strike face 302 to the rear 330. In some embodiments, the forged cavity back iron can have a top rail thickness 332 ranging from about 4.8 mm to 8.3 mm. For example, the top rail thickness 332 can range from about 4.8 mm to 5 mm, 5 mm to 5.2 mm, 5.2 mm to 5.4 mm, 5.4 mm to 5.6 mm 5.6 mm to 5.8 mm, 5.8 mm to 6 mm, 6 mm to 6.5 mm, 6.5 mm to 7 mm, 7 mm to 7.5 mm, 7.5 mm to 8 mm, or 8 mm to 8.3 mm. The forged cavity back iron can have a top rail thickness 332 of about 4.8 mm, 5 mm, 5.2 mm, 5.4 mm, 5.6 mm, 5.8 mm, 6 mm, 6.2 mm, 6.4 mm, 6.6 mm, 6.8 mm, 7 mm, 7.2 mm, 7.4 mm, 7.6 mm, 7.8 mm, 8 mm, or 8.3 mm. The forged cavity back iron in the illustrated embodiment has a top rail thickness 332 of about 6.6 mm. The top rail thickness 332 affects the ability to forge a cavity into the rear of the club head. Specifically, the greater the top rail thickness 332, the less clearance the forging tool will have to create the cavity. However, if the top rail is made too thin, for example, but not limited to, less than 4.8 mm, the moment of inertia will be reduced.

The forged cavity back iron further comprises a blade length 334. The blade length 334 is the length of the sole 324 measured from the heel most end to the toe most end. In some embodiments, the forged cavity back iron can have a blade length 334 ranging from 63 mm to 73 mm. For example, the blade length can range from 63 mm to 65 mm, 65 mm to 67 mm, 67 mm to 69 mm, 69 mm to 71 mm, or 71 mm to 73 mm. The forged cavity back iron can have a blade length 334 of 63 mm, 64 mm, 65 mm, 66 mm, 67 mm, 68 mm, 69 mm, 70 mm, 71 mm, 72 mm, or 73 mm. The forged cavity back iron in the illustrated embodiment has a blade length 334 of about 70 mm.

As described above, the length 375 of the cavity 358 can range 19 mm to 70 mm and the blade length 334 can range from 63 mm to 73 mm. Therefore, the cavity 358 can extend across almost the entire blade length 334.

In some embodiments the club head 300 can comprise a toe screw weight similar to the toe screw weight in the club head 200. The toe screw weight may have a mass ranging from 1 gram to 20 grams. For example, the toe screw weight may have a mass of about 1 gram, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, or 20 grams.

The club head 300 further comprises a moment of inertia Iyy about the Y'-axis (i.e. heel-to-toe moment of inertia). In some embodiments, the forged cavity back iron can comprise an Iyy ranging from 2000 $g*cm^2$ to 2750 $g*cm^2$. For example, in some embodiments the Iyy can be 2000 $g*cm^2$, 2050 $g*cm^2$, 2100 $g*cm^2$, 2150 $g*cm^2$, 2200 $g*cm^2$, 2250 $g*cm^2$, 2300 $g*cm^2$, 2350 $g*cm^2$, 2400 $g*cm^2$, 2450 $g*cm^2$, 2500 $g*cm^2$, 2550 $g*cm^2$, 2600 $g*cm^2$, 2650 $g*cm^2$, 2700 $g*cm^2$, or 2750 $g*cm^2$. In the illustrated embodiment the forged cavity back iron 300 has an Iyy of 2323 $g*cm^2$.

The forged cavity back iron further comprises a CG location measured along the y-axis (CGy). In some embodiments, the forged cavity back iron 300 can comprise a CGy ranging from −3 mm to −4.5 mm. For example, in some embodiments, the CGy can range from −3 mm to −3.25 mm, −3.25 mm to −3.5 mm, −3.5 mm to −3.75 mm, −3.75 mm to −4 mm, −4 mm to −4.5 mm. In some embodiments the CGy can be −3 mm, −3.1 mm, −3.2 mm, −3.3 mm, −3.4 mm, −3.5 mm, −3.6 mm, −3.7 mm, −3.8 mm, −3.9 mm, −4.0 mm, −4.1 mm, −4.2 mm, −4.3 mm, −4.4 mm, or −4.5 mm. In the illustrated embodiment the forged cavity back iron 300 has a CGy of −4.0 mm. By forming a cavity 358 and replacing the material of the golf club head 300 with a lighter material insert 310, there is a higher concentration of mass in the sole of the club and a low CGy value is achieved. The CGy of the illustrated embodiment is (but is not limited to being) 0.12 mm lower than that of Embodiment 1. This lower CGy value was achieved since the cavity of an example Embodiment 2 is shallower by about (but is not limited to being) 12 mm and wider by about (but is not limited to being) 5 mm when compared to Embodiment 1.

The rear cavity 358 is predominantly rectangular in shape. Additionally, the length 375 of the rear cavity 358 extends across most of the strikeface 302. The insert 310 touches all sides of the rear cavity 358 but one, the exposed surface 395. The edges of the walls of the rear cavity 358 are radiused to allow for flexure of the cavity 358 and ease of manufacturing.

The manufactured forged cavity back iron created via the multi-stage forging method disclosed herein provides the ability to create a rear cavity in a forged iron which provides the benefits of forging such as tighter grain structure and ease of manufacturing while also providing the benefits of a cavity back iron such has lower CG and higher MOI. The geometries of the cavity of the forged cavity back iron of Embodiment 2 have an added benefit of being easier to forge than those of Embodiment 1. While the difference in geometry of the cavity of Embodiment allowed for an easier forging process, the rest of the manufacturing process remained largely unchanged.

Third Embodiment

Figure 15:
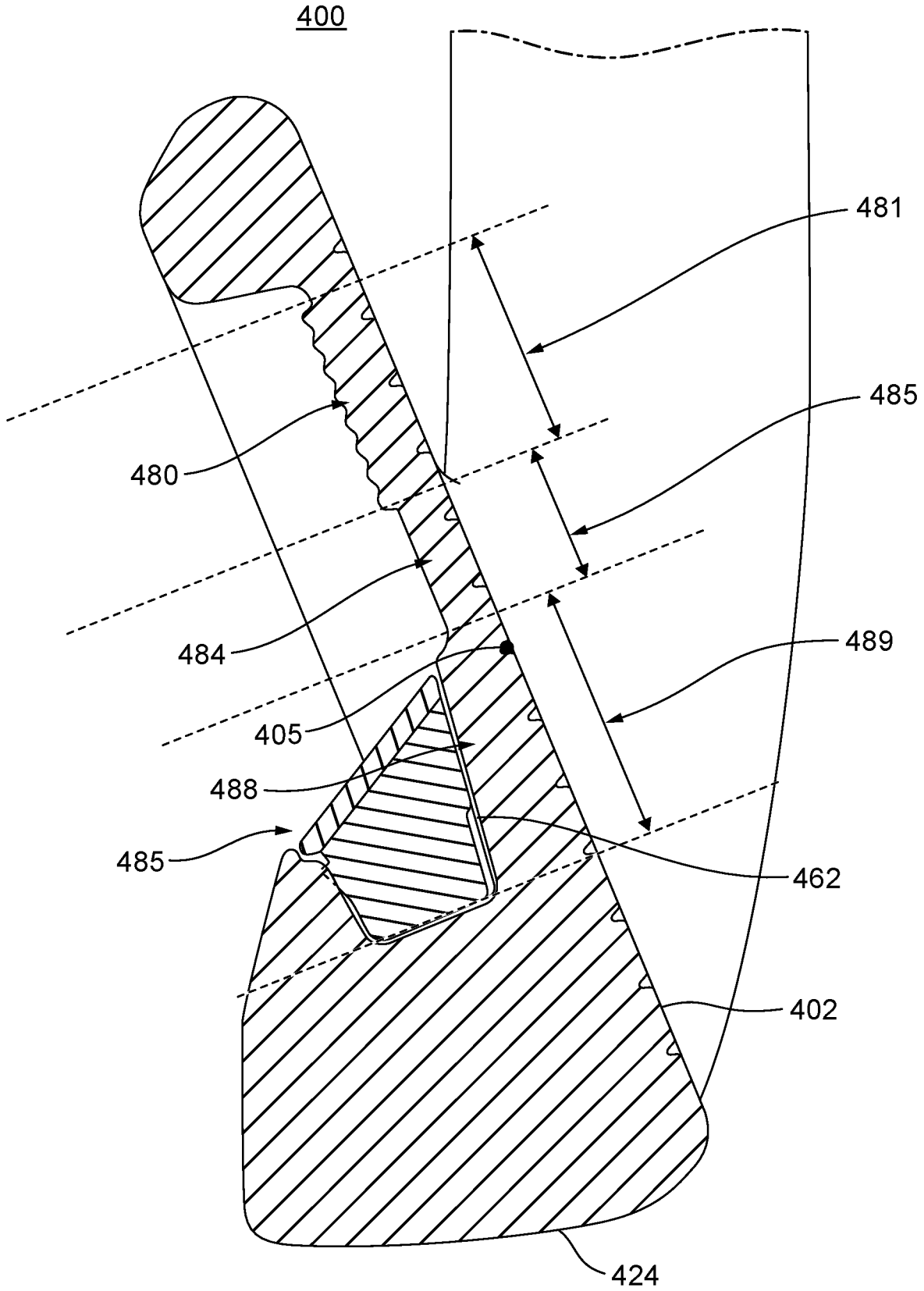
FIG. 15 illustrates a cross-sectional view of a manufactured golf club head with a cavity according to third embodiment.
Figure 16:
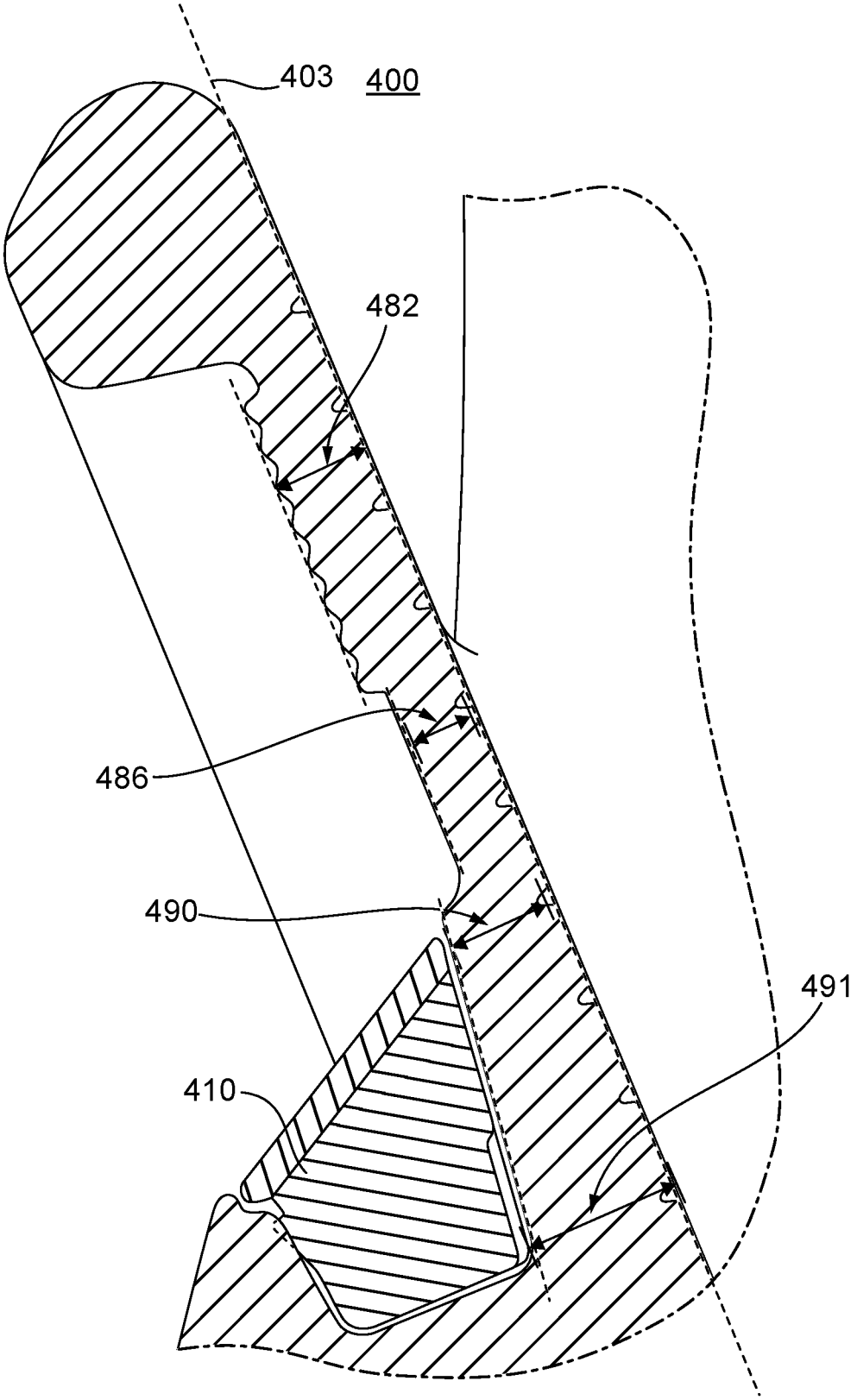
FIG. 16 illustrates a cross-sectional view of the club head of FIG. 15.
Figure 17:
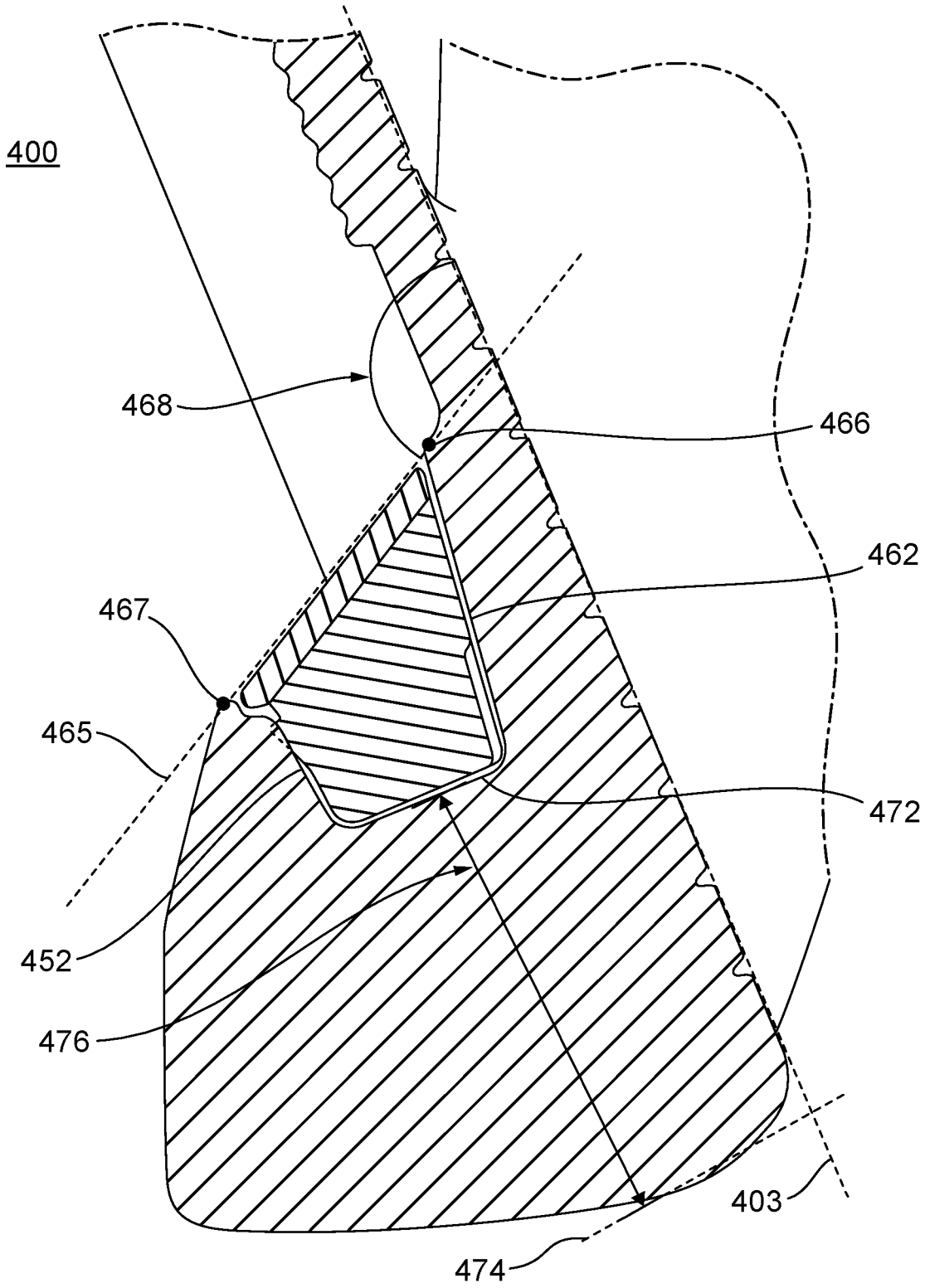
FIG. 17 illustrates a cross-sectional view of the club head of FIG. 15.

FIGS. 15-17 illustrate a third exemplary embodiment of a final forged cavity back iron 400 made according to the multi-stage forging process described herein. In this embodiment, the final forged cavity back iron 400 comprises a rear forged cavity formed via the multi-stage forging process as described above. The forged rear cavity removes mass from the center of the club head and redistributes the mass to the perimeter region and the sole region to increase the moment of inertia and lower the center of gravity, respectively.

The forged iron 400 in the illustrated embodiment is similar to previous embodiments described above in that the forged iron comprises a cavity that is formed through the use of the multi-stage forging process. The forged iron illustrated in FIGS. 15-17 is different from the embodiments illustrated in FIGS. 6-12 in that the forged iron comprises different cavity geometries and face geometries. Specifically, the strike face comprises different thicknesses at different regions. Furthermore, the cavity and the rear portion of the forged iron comprises different angles and geometries when compared to previous embodiments. These geometries, described in more detail below, improve ease of manufacturing while also increasing performance.

The forged iron 400 comprises a strike face 402. The strike face 402 comprises three regions: a top region 480, a middle region 484, and a cavity region 488, as illustrated in FIG. 15. The top region 480 comprises a first height 481 and a first thickness 482. The middle region 484 comprises a second height 485 and a second thickness 486. The cavity region 488 comprises a third height 489 and variable thickness. The first thickness 482, second thickness 486, and variable thickness are measured in a front to back direction, perpendicular to the loft plane. The height of each region is measured in a top to bottom direction, parallel to the loft plane. FIGS. 15-17 illustrate a cross-sectional view of the club head taken along the YZ plane, as defined above. The YZ plane is the plane that intersects the geometric center of the striking face and extends in a top rail to sole direction and a front to back direction. The geometries described below are measured in the YZ plane (midplane).

The first thickness 482 of the top region, as illustrated in FIG. 16, is approximately 2.46 mm. In other embodiments, the first thickness 482 can range from approximately 1.9 mm to 2.8 mm. For example, the first thickness 482 can range from approximately 1.9 mm to 2.0 mm, 2.0 mm to 2.1 mm, 2.1 mm to 2.2 mm, 2.2 mm to 2.3 mm, 2.3 mm to 2.4 mm, 2.4 mm to 2.5 mm, 2.5 mm to 2.6 mm, 2.6 mm to 2.7 mm, or 2.7 mm to 2.8 mm. The first thickness 482 is greater than the second thickness 486. In the illustrated embodiment, the first thickness 482 is approximately constant throughout the top region 480. The top region 480 can be defined by the first thickness 482.

The first height 481 of the top region 480 can range from approximately 3 mm to 12 mm. For example, the first height 481 can range from approximately 3 mm to 5 mm, 5 mm to 7 mm, 7 mm to 9 mm, 9 mm to 11 mm, or 11 mm to 12 mm. In the illustrated embodiment, the first height 481 is approximately 7.6 mm.

The top region 480 can further comprise cosmetic features which can be grooves or other patterns which are indented into the top region. In the embodiments which comprise cosmetic features, the first thickness 482 is measured as the maximum thickness.

The second thickness 486 of the middle region 484, as illustrated in FIG. 16, is approximately 1.9 mm. In other embodiments, the second thickness 486 can range from approximately 1.3 mm to 2.3 mm. For example, the second thickness 486 can range from approximately 1.3 mm to 1.5 mm, 1.5 mm to 1.7 mm, 1.7 mm to 1.9 mm, 1.9 mm to 2.1 mm, 2.1 mm to 2.3 mm. The second thickness 486 is less than the first thickness 482 and variable thickness. The second thickness 486 is approximately constant throughout the middle region 484.

The middle region 484 is the region at which the strike face 402 bends during the rough forging step, as described above. As such, the second thickness 486 of the middle region affects the bending properties of the forging step. Specifically, as the second thickness 486 decreases, the more bending is allowed, such that the clearance angle 36 decreases. However, if the second thickness 486 is made too thin, the durability of the strike face becomes compromised. Furthermore, the second thickness 486 affects the spacing of the cavity 458 relative to the strike face 402. As the second thickness 486 is decreased, the cavity 458 can be formed closer to the strike face 402.

The second height 485 of the middle region 486 has a similar effect on the bending properties as the thickness 486. As the second height 485 is decreased, the ability to bend the strike face 402 during the forging becomes more difficult. Furthermore, as the second height 484 is decreased, the clearance angle 36 will be required to decrease (i.e., more bending) in order to provide proper clearance for the forging press to form the cavity 458.

The second height 485 of the middle region 484, as illustrated in FIG. 15, is approximately 5.1 mm. In other embodiments, the second height 485 can range from approximately 0.6 mm to 7.6 mm. For example, the second height 485 can range from 0.6 mm to 1 mm, 1 mm to 2 mm, 2 mm to 3 mm, 3 mm to 4 mm, 4 mm to 5 mm, 5 mm to 6 mm, 6 mm to 7 mm, 7 mm to 7.6 mm. The second height 485, similar to the second thickness, affects the bending properties of strike face during the rough forging step. Furthermore, the middle region 484 is located above the center of the face 405 such that the middle region 484 does not comprise the face center 405. The middle region 484 is located above the cavity region 488 and below the top region 480. By locating the middle region 484 above the face center 405, the middle region 484 can be made thinner because approximately 80% of players impact the golf ball at or below face center 405. Therefore, the middle region 484 will not experience a significant number of impacts.

The second thickness 486 further aids in removal of the core piece after the final forging step. The core piece, as described above, is used to prevent deformation of the cavity during the final forging step in which the strike face is bent back to form the final club head. The second height 485 should be sufficiently large enough so that the core piece has enough space to pulled up and out of the cavity. If the second height 485 is not large enough, the core piece may get stuck or damage the iron during removal of the core piece.

As mentioned above, the cavity region 488 is located below the middle region 484. The cavity region 488 comprises the rear cavity 458. The cavity region 488 comprises a minimum thickness 490 and a maximum thickness 491. The minimum thickness 490 defines the top boundary of the cavity region 488 and the maximum thickness 491 defines the bottom boundary of the cavity region 488. The thickness of the cavity region 488 increases from a top direction downward due to the draft angle of the cavity 458. The cavity region 488 further comprises the face center 405 so that the cavity 458 and the insert 410 can be located directly behind or proximate the face center 405. Positioning the insert 410 behind and proximate the face center will improve the sound and feel of the club head.

The minimum thickness 490 of the cavity region 488, in the illustrated embodiment, is approximately 2.76 mm. In other embodiments, the minimum thickness 490 of the cavity region 488 can range from approximately 2.2 mm to 3.8 mm. For example, the minimum thickness 490 can range from approximately 2.2 mm to 2.6 mm, 2.6 mm to 3 mm, or 3 mm to 3.8 mm. Reducing the minimum thickness 490 improves sound and performance because the cavity will be placed closer to the strike face and impact location, and as such, the elastomeric insert will also be placed closer to the strike face and face center. Placing the insert closer to the face center will better dampen vibrations in the club head upon impact and improve the sound and feel. The multi-stage forging process allows the minimum thickness 490 to be reduced due to the increased clearance the upper die will have when hot-pressing the cavity into the rear of the club head. A forged iron made through traditional methods will not be able to achieve forming a cavity with an equivalent minimum thickness as the claimed invention. A forged iron made through traditional forging methods will require the rear cavity to be machined out. However, due to the top rail and other geometries of the strike face, the machine will not have enough clearance to machine the cavity close to the strike face. As such, a forged iron made through traditional forging methods will have a cavity that is placed further away from the strike face than the present invention.

The maximum thickness 491 of the cavity region 488, in the illustrated embodiment, is approximately 3.73 mm. In other embodiments, the maximum thickness 491 of the cavity region 488 can range from approximately 2.5 mm to 5 mm. For example, the maximum thickness 491 can range from 2.5 mm to 3 mm, 3 mm to 3.5 mm, 3.5 mm to 4.0 mm, 4.0 mm to 4.5 mm, or 4.5 mm to 5 mm. The maximum thickness 491 is measured from the front wall 462 that is proximate to the bottom of the cavity to the strike face 402. Similar to the minimum thickness 490, the maximum thickness 491 improves sound and performance because the cavity 458 will be placed closer to the strike face 402, and as such, the elastomeric insert 410 will also be placed closer to the strike face 402.

The forged iron 400 further comprises and offset distance. The offset distance is the difference between the first thickness 482 of the top region 480 and the minimum thickness 490 of the cavity region 488. The offset distance can range from approximately 0.1 mm to 0.6 mm. For example, the offset distance can range from approximately 0.1 mm to 0.2 mm, 0.2 mm to 0.3 mm, 0.3 mm to 0.4 mm, 0.4 mm to 0.5 mm, or 0.5 mm to 0.6 mm. The offset distance of the illustrated embodiment is approximately 0.27 mm. It is an aspect of the present invention to reduce the offset distance so that the insert may be placed closer to the strike face.

The forged iron 400 further comprises a cavity top surface angle 468, as illustrated in FIG. 17. The cavity top surface angle 468 is the angle formed between a cavity top surface plane 465 to the strike face 402. The cavity top surface plane 465 extends in a heel to toe direction. The cavity top surface plane 465 further intersects a top front point 466 and a top back point 467. The top front point 466 is the topmost point of the front wall 462. Similarly, the top back point 467 is the topmost point of the rear wall 452. The cavity top surface angle 468 in the illustrated embodiment is approximately 117 degrees. In other embodiments, the cavity top surface angle 468 can range from approximately 91 degrees to 130 degrees. For example, the cavity top surface angle 468 can range from approximately 91 degrees to 101 degrees, 101 degrees to 110 degrees, 110 degrees to 120 degrees, or 120 degrees to 130 degrees. The larger the cavity top surface angle 468 is, the less the strike face needs to bend during the bent face step. For example, the cavity top surface angle 468 in the illustrated embodiment is approximately 117 degrees and the strike face bending angle 36 was approximately 10-15 degrees during the rough forging step. In other words, the cavity top surface angle creates more clearance for the tool as the cavity top surface angle increases.

The forged iron further comprises a cavity height 476. The cavity height 476 is measured parallel to the loft plane, from a sole plane 474 of the club to the bottom wall. The sole plane is perpendicular to the loft plane 403 and tangent to the sole 424. The cavity height 476 of the illustrated embodiment is approximately 11.68 mm. In other embodiments, the cavity height can range from approximately 2.5 mm to approximately 14 mm. For example, the cavity height can range from 2.5 mm to 4 mm, 4 mm to 6 mm, 6 mm to 8 mm, 8 mm to 10 mm, 10 mm to 12 mm, or 12 mm to 14 mm.

The above described geometries of the forged iron 400 improve performance and ease of manufacturing over embodiments 200 and 300 described above, which lack the specific geometries. The geometries discussed above, when implemented together, allow for the cavity to be placed closer to the strike face, improving performance, while simultaneously improving ease of manufacturing by increasing the clearance for the tool to create the cavity. The geometries of the cavity further improve the ability to remove the tool from the cavity after the forging of the cavity. The above geometries can further be adjusted to fine tune the center of gravity location, ease of manufacture, and overall aesthetics of the iron.

The embodiment described above and depicted in FIGS. 15-17 comprises specific geometry, achieved through the use of the multi-stage forging process described herein, that improves manufacturing and performance as described above. The first thickness, second thickness, and height of the middle portion are selected to create a cavity that is closer to the strike face and provide more clearance for the tool that creates the cavity so that the strike face can bend less during the rough forging step. The reduction in the clearance angle will improve the yield in a batch of forged irons. By bending the strike face more during the rough forging step, you increase that chances of the material failing and going the elastic yield limit. A batch of forged irons of the embodiment of FIGS. 15-17 could have approximately 90% yield results (1 out of 10 clubs are damaged/scrapped) while other embodiments could have a yield results of 80% or less due to the material failing during the rough forging step.

Fourth Embodiment

Figure 18:
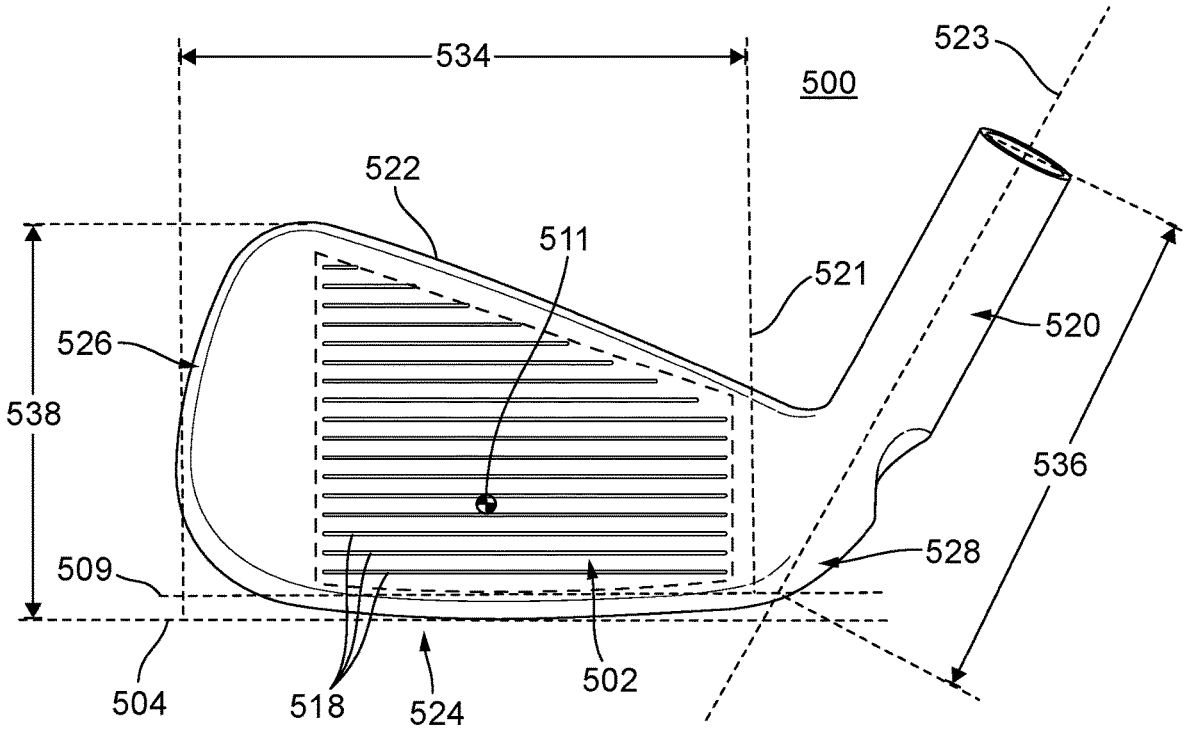
FIG. 18 illustrates a front view of a manufactured golf club head according to a fourth embodiment.
Figure 19:
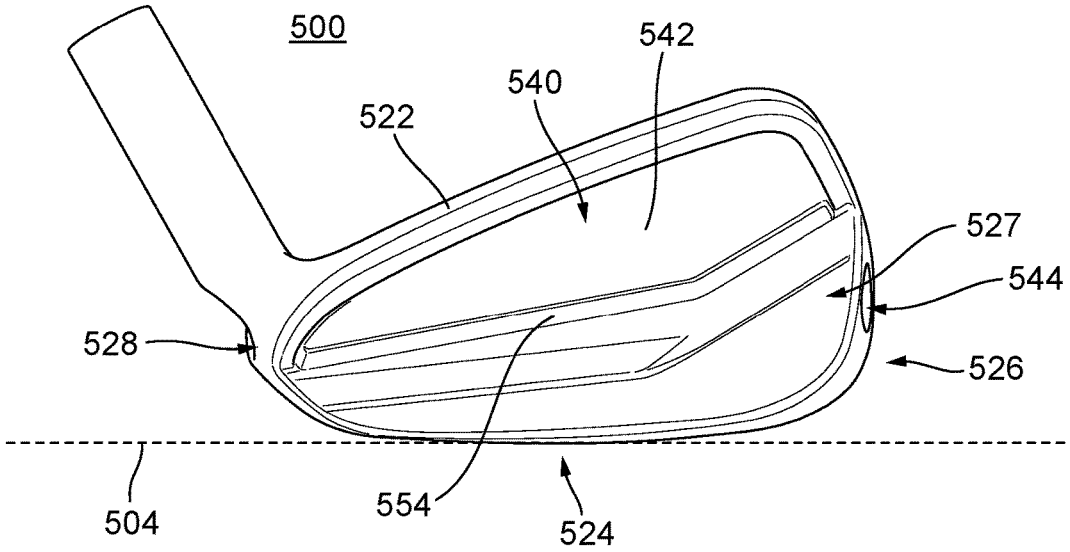
FIG. 19 illustrates a rear view of the club head of FIG. 18.
Figure 20:
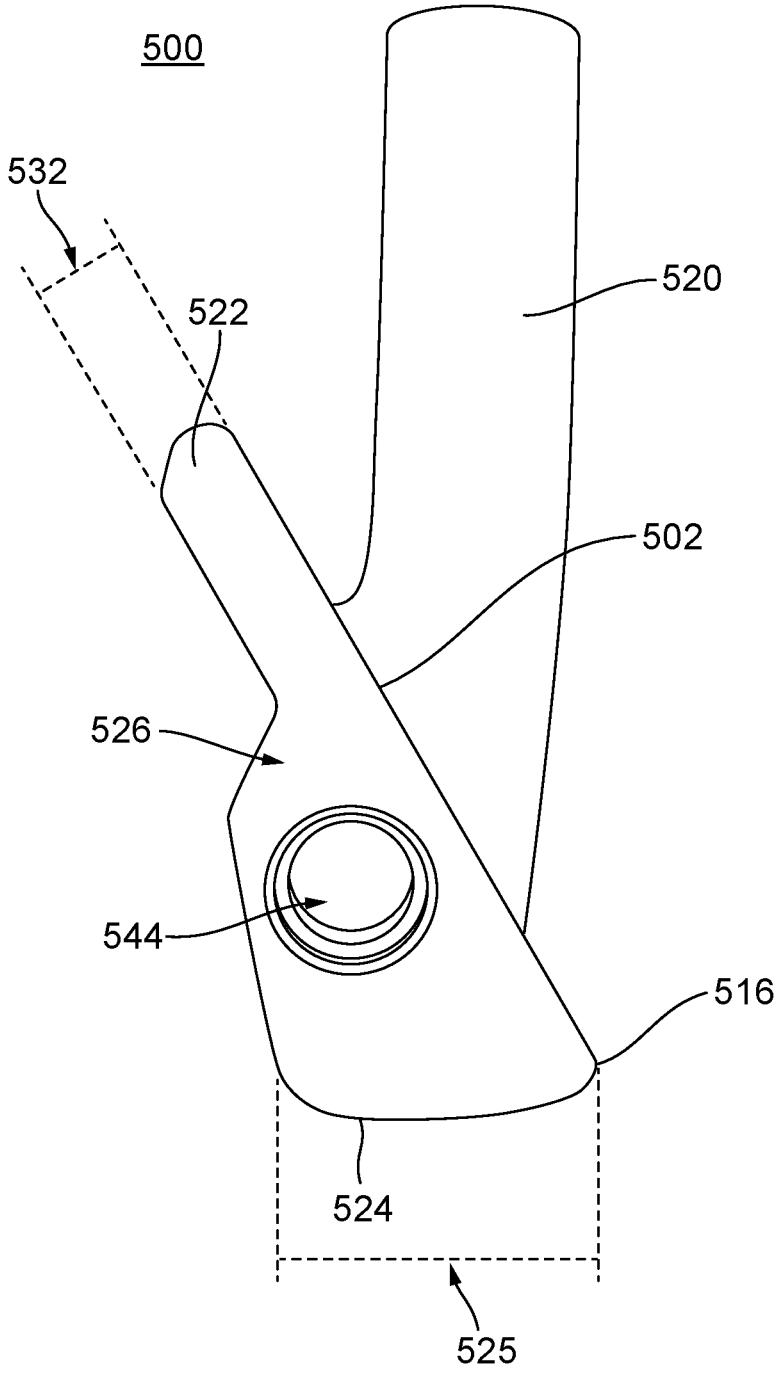
FIG. 20 illustrates a toe view of the club head of FIG. 18.

FIGS. 18-20 illustrate a fourth exemplary embodiment of a final forged cavity back iron made according to the multi-stage forging process described herein. The club head 500 is similar to the club heads 200, 300, and 400 described previously in that the club head 500 is forged and can comprise a rear cavity. The club head 500 is different from previous embodiments in that the club head 500 comprises various geometries to alter the overall mass properties of the club head. For example, the club head 500 balances the face height, hosel length, blade length, sole width, and top rail thickness to provide improved mass properties.

The iron-type golf club head 500 comprises a strike face 502, a back face 542 opposite the strike face 502, a top rail 522, a sole 524 opposite the top rail 522, a toe portion 526, and a heel portion 528 opposite the toe portion 526. The top rail 522, sole 524, toe portion 526, and heel portion 528 each extend rearwardly from the perimeter of the strike face 502. The club head 500 further comprises a ledge 554 extending upward from the sole 524, at least partially between the sole 524 and the top rail 522. The club head 500 further comprises a hosel 520 located proximate to the heel portion 528 and configured to receive a golf club shaft (not shown). The strike face 502 further defines a plurality of score lines 518 extending in a heel-toe toe direction parallel to the ground plane 504.

The iron-type golf club 500 can comprise a rear toe portion 527 to aid in maintaining an acceptable moment of inertia. The rear toe portion 527 comprises a buildup of material towards the toe end of the club. The toe portion 526 can further comprise a toe cavity 544 on the toe portion 526 of the club 500. The toe cavity 544 can be designed to receive a toe screw (not shown) similar to toe screw 245 above. In some embodiments, the toe cavity 544 can be machined into the club head. In other embodiments, the toe cavity 544 can be made during the forging process described above. The toe screw can be made from a material that is of greater density than the material the club head 500 is made from. The combination of the toe screw and rear toe portion 527 increases the Iyy of the iron-type golf club to maintain an acceptable moment of inertia. The iron-type golf club 500 can further comprise a rear cavity 540 to aid in perimeter weighting to maintain an acceptable moment of inertia.

The iron iron-type golf club 500 can comprise a rear cavity 540 formed between the rear ledge 554, the top rail 522, the toe 526, and the heel 528. The cavity 540 is formed generally parallel to the loft plane. The rear cavity 540 further comprises a rear cavity surface 542. The rear cavity surface 542 is generally parallel to the loft plane. The rear cavity 540 removes mass from the central upper portion of the club 500. Removing the mass from the central upper portion of the club pushes the mass both towards the perimeter and towards the sole 524. Pushing the mass towards the perimeter maintains an acceptable MOI. Pushing the mass towards the sole 524 lowers the CG of the iron-type golf club 500.

The iron-type golf club head 500 further comprises a hosel length 536, a blade length 534, a face height 538, a sole width 525, a top rail thickness 532, a mass, a mass moment of inertia, and a center of gravity 511.

The hosel length 536 of the iron-type golf club 500 is measured along a hosel axis 523. The hosel axis 523 extends through the center of the hosel bore. The hosel length is measured from the topmost portion of the hosel 520 to the point at which the hosel axis 523 intersects a leading edge plane 509. The leading edge plane 509 is parallel to the ground plane 504 and intersects the leading edge. The hosel length 536 can be between 44 mm and 69 mm. In some embodiments, the hosel length 536 can be 50 mm, 51 mm, 52 mm, 53 mm, 54 mm, 55 mm, 56 mm, 57 mm, 58 mm, 59 mm, 60 mm, 61 mm, or 62 mm. In some embodiments, the hosel length 536 can be between 50 mm and 55 mm, 55 mm and 60 mm, 60 and 65 mm, or 65 and 68 mm. In an exemplary embodiment, the hosel length 536 is 58 mm. The hosel length 536 contributes to keeping the center of gravity 511 low in the iron-type golf club by moving more mass of the club towards the sole 524.

The blade length 534 of the iron-type golf club 500 is measured from the toemost portion of the club head to a hosel transition axis 521. The hosel transition axis 521 extends in a top to bottom direction, perpendicular to the ground plane 504. The hosel transition axis 521 is located at the point where the strike face 502 transitions to the hosel 520. The blade length 534 can be between 60 mm to 76 mm. For example, the blade length 534 can be between 60 mm and 65 mm, 65 mm and 70 mm, or 70 mm and 76 mm. In the illustrated embodiment, the blade length 534 is about 70 mm.

The face height 538 is measured from the top most portion of the top rail 522 to the bottom most portion of the sole 504 when the club head is at an address position. The face height 538 of the iron-type golf club 500 can be between 43 mm and 58 mm. For example, the face height 538 can be between 43 mm and 45 mm, 45 mm and 48 mm, 48 mm and 51 mm, 51 mm and 54 mm, or between 54 mm and 58 mm. In an exemplary embodiment, the face height 538 is 49.5 mm. The face height 538 contributes to keeping the center of gravity 511 low in the iron-type golf club by moving more mass towards the sole 524.

The sole width 525 is the distance measured along the Z-axis between the leading edge 516 and the junction between the rear wall and the sole 525 of the club head 500. The sole width 525 of the iron-type golf club 500 can be between 12 mm and 20 mm. For example, the sole width 525 can be between 12 mm and 14 mm, 14 mm and 16 mm, 16 mm and 18 mm, or 18 mm and 20 mm. In an exemplary embodiment, the sole width can be 17 mm.

The top rail thickness 532 is the distance between the strike face 502 to the rear most portion of the top rail 522, measured perpendicular to the strike face 502. The top rail thickness 532 of the iron-type golf club 500 can be between 2.5 mm and 10 mm. For example, the top rail thickness can be between 2.5 mm and 4 mm, 4 mm and 5 mm, 5 mm and 6 mm, 6 mm and 7 mm, 7 mm and 8 mm, 8 mm and 9 mm, or 9 mm and 10 mm. In an exemplary embodiment, the top rail thickness is about 6.9 mm.

The mass of the iron-type golf club head 500 can be between 220 grams and 290 grams. In some embodiments the mass can range between 220 grams and 235 grams, 235 grams and 245 grams, 245 grams and 255 grams, 255 grams and 265 grams, 265 grams, and 275 grams, or between 275 grams and 290 grams.

The above dimensions and features, such as the hosel length 534, blade length 534, face height 538, sole width 525, top rail thickness 532, and rear toe portion 527 can be used in conjunction with the multi-stage forging described above to create a forged golf club head comprising a cavity configured to receive an insert. The forged golf club head comprising an insert and the above combination of dimensions will have a substantially low center of gravity and high moment of inertia to improve carry distance, launch, spin, and accuracy when compared to traditional forged irons lacking an insert. Furthermore, the above dimensions and features may also be implemented into the embodiments 200, 300, and 400 above to improve mass properties and performance.

H. Method of Manufacturing a Set of Golf Clubs and a Forged Set of Clubs with Similar Sized Cavities Referring to FIG. 1, the multi-stage forging method, comprises four stages: (1) a rough forging stage, in which intermediate club head body 10 is formed from a solid block billet (not shown); (2) a hot-pressing stage, in which a cavity 58 is formed in the intermediate club head body; (3) a precision forging stage wherein the intermediate club head body 10 is formed into a final golf club head 80; (4) and an insert 110 or filling is placed within the cavity 58 of the golf club head body 80. This multi-stage forging method allows a manufacturer to create a forged golf club head 80 with a deep undercut cavity 58, from a single solid billet. However, in this embodiment, the multi-stage forging method comprises a fifth stage (not shown), wherein a shaft and grip are attached to the golf club head body 80, to form a golf club. The multi-stage forging process is then repeated to form multiple iron-type golf club heads with cavities, wherein the multiple iron-type golf clubs with cavities will comprise different lofts (aforementioned) to form a set of golf clubs (i.e., 2 iron, 3 iron, 4 iron, 5 iron, 6 iron, 7 iron, 8 iron, 9 iron, PW).

In some embodiments, the multi-stage forging process can form multiple iron-type golf club heads with identically sized cavities, and different lofts to form a set of golf clubs. With identically sized cavities, the inserts that are affixed to each golf club head, all have an exact same volume, but can have varying densities and therefore varying masses. This variability allows the inserts for each golf club head of the golf club set to have different swing weights and/or different CG locations. Furthermore, this make the manufacturing of the inserts more efficient, since only the material (therefore changing the density) of the insert needs to be changed, in order to change the weighting of the insert, for each club head. Inserts are produced at different weights in order to account for manufacturing tolerances (i.e., if a golf club head is supposed to weight 425 grams, but only weighs 415 grams, then a 10 gram weight can be added to the golf club head cavity).

The aforementioned method of manufacturing produces can produce of set of forged iron-type golf clubs with similar sized cavities. In reference to FIG. 5, the final golf club head 80 formed by the method of manufacturing comprises a hosel 120, a top rail 122, a sole 124, a toe region 126, a heel region 128, a rear 130, a strike face 20 (not shown), a cavity 58, an insert 110, a shaft (not shown), and a grip (not shown). The set of forged iron-type golf clubs can comprise 2 golf clubs, 3 golf clubs, 4 golf clubs, 5 golf clubs, 6 golf clubs, 7 golf clubs, 8 golf clubs, 9 golf clubs, or 10 golf clubs.

Each golf club of the forged iron-type golf club set can comprise cavity 58 having a volume of approximately 0.8 cc, 1.0 cc, 1.25 cc, 1.5 cc, 1.75 cc, 2.0 cc, 2.25 cc, 2.5 cc, 2.75 cc, 3.0 cc, 3.25 cc, 3.5 cc, 3.75 cc, 4.0 cc, 4.25 cc, 4.5 cc, 4.75 cc, 5.0 cc, 5.25 cc, 5.5 cc, 5.75 cc, 6.0 cc, 6.25 cc, 6.5 cc, 6.75 cc, 7.0 cc, 7.25 cc, 7.5 cc, 7.75 cc, 8.0 cc, 8.25 cc, 8.5 cc, 8.75 cc, 9.0 cc, 9.25 cc, 9.5 cc, 9.75 cc, 10.0 cc, 10.25 cc, 10.5 cc, 10.75 cc, 11.0 cc, 11.25 cc, 11.5 cc, 11.75 cc, 12.0 cc, 12.25 cc, 12.5 cc, 12.75 cc, 13.0 cc, 13.25 cc, 13.5 cc, 13.75 cc, 14.0 cc, 14.25 cc, 14.5 cc, 14.75 cc, 15.0 cc, 15.25 cc, 15.5 cc, 15.75 cc, 16.0 cc, or any other suitable volume value in between those volume values, and can range from any one of those volume values to any other one of those volume values. In one embodiment, the volume of the cavity 58 is 4.25 cc. The volume of the cavity 58 can be substantially similar to the volume of an insert that is affixed within the cavity 58. The volume can also be approximately identical for each golf club of the forged iron-type golf club set.

The aforementioned method of manufacturing can produce a mixed set of forged iron-type golf club heads such that a portion of the set of clubs are made through the multi-stage forging process disclosed herein and the remainder portion of the set are made using a standard forging method. The mixed set of forged iron-type golf club heads comprise at least one club in the set of clubs that has a cavity made through the forging process disclosed herein. The mixed set of forged iron-type golf club heads further comprise at least one club in the set of clubs that does not have a cavity (i.e., muscle back iron) and is made through a traditional forging process. For example, in a set of mixed forged irons, irons having a loft of 27 degrees or less (i.e., 5 iron, 4 iron, 3 iron, 2 iron) can comprise a forged cavity made through the forging process described above while irons with lofts higher than 27 degrees (i.e., 6 iron, 7 iron, 8 iron, 9 iron, PW) do not have a forged cavity. The lower lofted irons (i.e., 5 iron, 4 iron, and 3 iron) are typically more challenging to hit and thus can benefit from a rear cavity created through the aforementioned method of manufacturing. The rear cavity lowers the CG and improves the MOI making the lower lofted irons launch higher, more forgiving, and overall easier to hit.

I. Benefits

The enclosed manufacturing process is an improvement over the current industry standard. The multi-stage forging process utilizes a process in which an intermediate club head 10 is formed with a strike face 20 that is bent at a clearance angle 36, enabling a cavity 58 to be hot pressed opposite of the strike face 20. The strike face 20 is then bent back into a functional strike face 20, and a final golf club head 80 is created. This bent strike face 20 technique allows a manufacturer to create a forged golf club head body 80 with a deep undercut cavity 58, from a single solid billet.

By creating an entirely forged golf club head 80, with a deep undercut cavity 58, a tighter grain structure of the golf club head is achieved. With a tighter grain structure, the durability of the golf club head 80 is improved. Forging the golf club head 80 with a deep undercut cavity 58 from the billet process, allows a more durable cavity style iron than current cast cavity irons, because of a tighter and more consistent grain structure.

Figure 13:
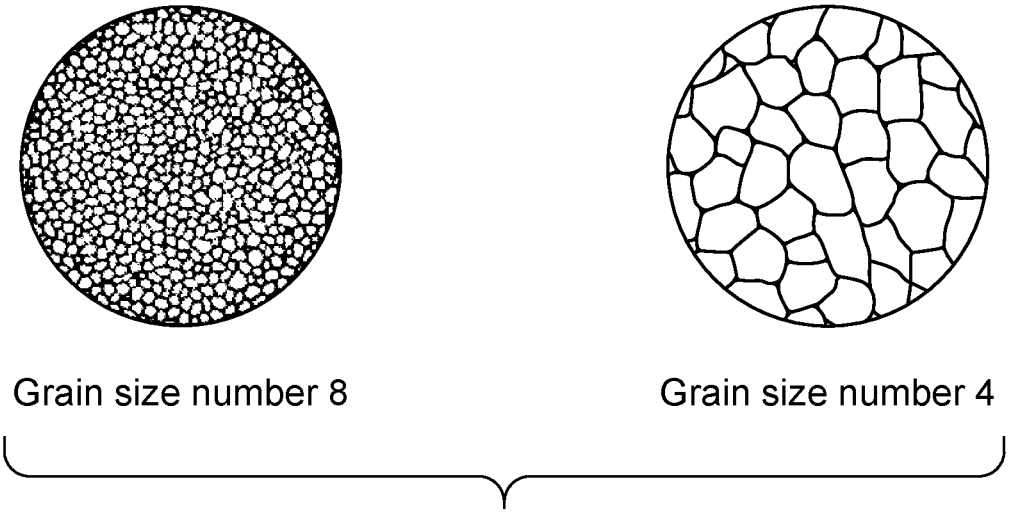
FIG. 13 illustrates a comparative example of an exemplary club head and a control club head.

The forged cavity back irons 200, 300, 400, 500 described above further comprise a grain structure, as illustrated in FIG. 13. The grain structure is quantified by using the ASTM-E112 standard test methods. The grain size number is a relationship to the number of grains that can be seen through 100× magnification. In all embodiments described above, the forged club heads have a grain size number of about 7. In other embodiments the grain size number can be 6, 7, or 8. A larger ASTM-E112 grain size number suggests a smaller grain size when viewed under magnification. For example, as illustrated in FIG. 13, a casted club head can comprise a grain size number of about 4. As observed, the grain size of the casted club head appears to be much larger than the grain size of a forged club head.

Further, this multi-stage forging method is more repeatable than current casting methods. Current casting methods require manual machining processes to remove excess material and clean the shape of the club head, whereas the forging method requires little to no machining. Thus, the forging process is more repeatable since there is less uncertainty involved from hand machining techniques. This improves overall tolerances of the completed club head over a casted club head. Furthermore, with less machining processes involved in the golf club head production, the enclosed invention lowers the overall cost of producing a premium golf club head with an undercut cavity.

The golf club head created from this multi-stage forging method, is comparable in feel and performance to a casted golf club head of similar geometry. Since the forged iron comprises a stronger composition, the strike face is able to be made thinner, thereby increasing the flexibility of the strike face. The forged iron thus increases ball speed and workability (shot bend) over a casted golf club head of similar geometry, while maintaining or improving spin rates, sound characteristics, and feel characteristics.

Example 1

Provided below is a an example comparing an exemplary golf club head according to an embodiment of the present invention to a control club head. The comparative example is meant to illustrate the benefits of a forged iron created using the aforementioned multi-stage forging process over a forged iron currently in use in the market.

The exemplary club head is a forged iron comprising a cavity and an insert, similar to embodiment 400 described above. The exemplary club head was manufactured through the multi-stage forging process. The first forging step in the club head was created through rough forging a solid billet of 8620 carbon steel. The club head comprised a bent strike face, allowing a cavity to be formed in the rear via a hot pressing step. The bent strike face was then precision forged to create a manufactured golf club head with a flat strike face, and a cavity configured to receive an insert. The insert was then adhered to the cavity. The cavity comprised a similar width and depth to the cavity of the club head 300 described above. The cavity had a width of approximately 8 mm at the top of the cavity and a width of approximately 6.42 mm at the bottom of the cavity. The depth of the cavity was approximately 4 mm. The exemplary club is a 4 iron with a loft of about 22 degrees.

The control club head used in the comparative example was a forged iron created using only a single step forging process. The control club head does not comprise a cavity. However, the control club head does comprise similar overall dimensions as the exemplary club head described above.

The mass properties of the exemplary club head were compared to the control club head. The mass properties were measured using Computer Aided Design (CAD) software. Using the coordinate system as defined above, the mass properties were measured for the exemplary club and control club. The CGy and Iyy were measured for each club head. The CGy is the position of the center of gravity along the y-axis. In other words, the CGy shows the position of the center of gravity with respect to the ground plane. The Iyy is the heel-to-toe moment of inertia about the club heads Y' axis.

TABLE 1

| | Exemplary Club Head | Control Club Head |
|---|---|---|
| CGy | −3.88 mm | −2.56 mm |
| Iyy | 2323 g * $cm^2$ | 2103 g * $cm^2$ |

As illustrated in Table 1, the exemplary club head comprises a CGy of −3.88 mm while the control club head comprises a CGy of −2.56 mm. A larger CGy value indicates that the center of gravity is further from the face center and closer to the ground plane (i.e., a lower CG). Therefore, the exemplary club head has a CGy that is lower than the control club head by 1.32 mm. The low CGy of the exemplary club head was achieved through the use of the rear cavity and insert. The rear cavity removed mass from the middle of the club head so that more mass is placed in a lower portion of the club. A lower CGy can create higher launch angle and increased ball speeds which are particularly beneficial in longer irons such as a 4 iron.

Furthermore, the exemplary club head comprises an Iyy of 2323 g*$cm^2$ while the control club head comprises an Iyy of 2103 g*$cm^2$. The exemplary club head had an increase in Iyy of 220 g*$cm^2$ over the control club head. The higher Iyy will create a more forgiving club head on mishits leading to overall increase in accuracy over the control club head. The forged cavity of the exemplary club head allows for more mass to be placed at the perimeter of the club head, thereby increasing the moment of inertia Iyy.

The exemplary club head has been shown to increase carry distance and provide more forgiveness than the control club head by having a lower CGy location and a higher MOI value, respectively. The multi-stage forging process allows for improvements to geometries to achieve this lower CGy and higher Iyy. Specifically, the cavity created in the second stage of the forging process allows for more mass to be placed to the perimeter of the club head and lowers the center of gravity. The depth and total volume of the cavity affects the CGy position. A larger depth and a larger volume allow for more discretionary mass to be placed elsewhere in the club. The cavity removes mass from the central portion of the club so that the mass can be placed towards the sole and towards the perimeter, thereby lower the CGy and increasing the MOI, respectively.

Example 2

Provided below is a comparative example comparing an exemplary golf club head according to an embodiment of the present invention to a control club head. The comparative example is meant to illustrate the equivalent mass properties of a forged iron according to an embodiment of the present invention when compared to a control club head that has been made through a casting method.

The exemplary club head is a forged iron comprising a cavity and an insert, similar to embodiment 400 described above. The exemplary club head was manufactured through the multi-stage forging process. The first forging step in the club head was created through rough forging a solid billet of 8620 carbon steel. The club head comprised a bent strike face, allowing a cavity to be formed in the rear via a hot pressing step. The bent strike face was then precision forged to create a manufactured golf club head with a flat strike face, and a cavity configured to receive an insert. The cavity comprised a similar width and depth to the cavity of the club head 300 described above. The cavity had a width of approximately 8 mm at the top of the cavity and a width of approximately 6.42 mm at the bottom of the cavity. The depth of the cavity was approximately 4 mm. The exemplary club is a 4 iron with a loft of about 22 degrees.

The control club head used in this comparative example is a casted iron type club head with a rear cavity and an insert. The control club head comprises similar overall dimensions as the exemplary club head described above.

The mass properties of the exemplary club head were compared to the control club head. The mass properties were measured using Computer Aided Design (CAD) software. Using the coordinate system as defined above, the mass properties were measured for the exemplary club and control club. The CGy and Iyy were measured for each club head. The CGy is the position of the center of gravity along the y-axis. In other words, the CGy shows the position of the center of gravity with respect to the ground plane. The Iyy is the heel-to-toe moment of inertia about the club heads Y' axis.

TABLE 2

| | Exemplary Club Head | Control Club Head |
|---|---|---|
| CGy | −3.88 mm | −3.81 mm |
| Iyy | 2323 g * $cm^2$ | 2309 g * $cm^2$ |

As illustrated in Table 1, the exemplary club head comprises a CGy of −3.88 mm and the control club head comprises a CGy of −3.81 mm. A larger CGy value indicates that the center of gravity is further from the face center and closer to the ground plane (i.e., a lower CG). Therefore, the exemplary club head has a CGy that is approximately the same as the control club head. As such, it is possible to achieve an equivalent CGy location using only the aforementioned multi-stage forging process as a club head that has been casted. The low CGy of the exemplary club head was achieved through the use of the rear cavity and insert. The rear cavity removed move from the middle of the club head so that more mass is placed in a lower portion of the club.

Furthermore, the exemplary club head comprises an Iyy of 2323 g*$cm^2$ while the control club head comprises an Iyy of 2309 g*$cm^2$. Therefore, the exemplary club head has an Iyy that is approximately the same as the control club head. As such, it is possible to achieve an equivalent Iyy value using only the aforementioned multi-stage forging process (i.e., no milling) as a club head that has been casted. The forged cavity of the exemplary club head allows for more mass to be placed at the perimeter of the club head, thereby increasing the moment of inertia Iyy.

The exemplary club head has been shown to achieve approximately equivalent mass properties as the control club head. The multi-stage forging process allows for geometries to be created that have previously been only obtainable through other means of manufacturing such as casting and milling which are expensive and time consuming. Specifically, the cavity created in the second stage of the forging process allows for more mass to be placed to the perimeter of the club head and lowers the center of gravity. The depth and total volume of the cavity affects the CGy position. A larger depth and a larger volume allow for more discretionary mass to be placed elsewhere in the club. The cavity removes mass from the central portion of the club so that the mass can be placed towards the sole and towards the perimeter, thereby lower the CGy and increasing the MOI, respectively.

Example 3

Provided below is an example comparing an exemplary golf club head according to an embodiment of the present invention to a control club head. The comparative example is meant to illustrate the difference in grain structure between a forged iron and a cast iron.

The exemplary club head, similar to club head used in Example 1 and 2, is a multi-staged forged iron comprising a cavity and an insert. The exemplary club head was manufactured through a multi-stage forging process. The first forging step in which an intermediate club head was created through rough forging a solid billet of 8620 carbon steel. The intermediate club head comprises a bent strike face, allowing a cavity to be formed in the rear via a hot pressing step. The bent strike face was then precision forged to create a final golf club head with a flat strike face and a cavity configured to receive an insert. The insert was then adhered to the cavity. The exemplary club is a 4 iron with a loft of about 22 degrees. It should also be noted that the exemplary club head was created with very little to no milling.

The control club head used in this comparative example is a casted iron type club head with a rear cavity and an insert. The control club head comprises similar overall dimensions as the exemplary club head described above.

As illustrated in the FIG. 13, the exemplary club head comprises a grain size number of 8 according to the ASTM-E112 standard test methods for determining average grain size in which the grains were examined under 100× magnification. On the contrary, the control club head which was casted comprises a grain size number of 4. The grain size number is inversely related to the grain size. As the grain size number increases, the actual grain size when viewed under the microscope will appear smaller. Similarly, as the grain size number decreases, the actual grain size when viewed under the microscope will appear larger. This suggests that the grain sizes of the exemplary embodiment are smaller and tighter than the grain sizes of the control club head. As mentioned above, smaller and tighter grain structure leads to an increase of durability of the club head.

Example 4

Provided below is an example comparing an exemplary golf club head according to an embodiment of the present invention to a control club head. The comparative example is meant to illustrate the performance of a forged iron according to an embodiment of the present invention when compared to a control club head that has been made through a traditional forging method.

The exemplary club head, similar to club head used in Example 1, 2, and 3, is a multi-staged forged iron comprising a cavity and an insert. The exemplary club head was manufactured through a multi-stage forging process. The first forging step in which the club head was created through rough forging a solid billet of 8620 carbon steel. The club head comprised a bent strike face, allowing a cavity to be formed in the rear via a hot pressing step. The bent strike face was then precision forged to create a manufactured golf club head with a flat strike face and a cavity configured to receive an insert. The insert was then adhered to the cavity. The cavity comprised a similar width and depth to the cavity of the club head 300 described above. The cavity had a width of approximately 8 mm at the top of the cavity and a width of approximately 6.42 mm at the bottom of the cavity. The depth of the cavity was approximately 4 mm. Further, the strike face comprised a top region, middle region, and cavity region as described in embodiment 400 above. The thickness of the middle region was approximately 1.9 mm. The width of the cavity region (i.e., the cavity offset distance) ranged from a minimum thickness of 2.76 to a maximum thickness of 3.73 mm. The exemplary club is a 4 iron with a loft of about 22 degrees.

The control club head used in this comparative example is a traditionally forged blade style iron type club head. The control club head comprises a slightly higher CG than the exemplary club head.

Player testing was conducted to directly compare the performance of the exemplary club head and the control club head. Shot data was collected using a launch monitor for every participant.

TABLE 3

| | Exemplary Club Head | Control Club Head |
|---|---|---|
| Ball Speed | 133.8 mph | 132.0 mph |
| Carry Distance | 200.2 yards | 196.4 yards |
| Stat Area | 1199 $yd^2$ | 1318 $yd^2$ |

Illustrated in Table 3, the exemplary club head produced faster ball speeds and longer carry distances for the participants when compared to the control club head. Participants saw an increase of approximately 1.8 mph in ball speed and an increase of approximately 3.8 yards of additional carry distances on average using the exemplary club head. Further, the stat area provides a statistical representation of the spatial dispersion seen with a set of shots. Smaller stat areas equate to more precise results. Table 3 shows that both the exemplary club and control club have a similar stat area, wherein the exemplary club performed slightly better. The exemplary club had a stat area of 1199 $yd^2$ and the control club had a stat area of 1318 $yd^2$.

These results showed the exemplary club head to provide increased ball speed and distance, while also decreasing the dispersion area compared to the control club head. Increased distance and accuracy are desired by golfers at all levels. In conclusion, the exemplary club head outperformed the control club head due to the improved MOI and CG numbers achieved through the use of the multi-stage forging process described herein. The multi-stage forging process created a rear cavity in the exemplary club head. The rear cavity allowed for additional mass savings so that more mass may be placed lower in the club and at perimeter portions to lower the CG and increase MOI, respectively. The lower CG helps increase ball speed because the lower CG is closer to and more inline with the force line of the club head and ball. The increased MOI helps reduce the stat area by reducing the club heads tendency to twist upon impact with a golf ball.

Example 5

Provided below is a comparative example comparing an exemplary golf club head according to an embodiment of the present invention to a control club head. The comparative example is meant to illustrate the performance of a forged iron according to an embodiment of the present invention when compared to a control club head that has been made through a traditional forging method.

The exemplary club head, similar to club head used in Example 1, 2, 3, and 4 is a multi-staged forged iron comprising a cavity and an insert. The exemplary club head was manufactured through a multi-stage forging process. The first forging step in which an intermediate club head was created through rough forging a solid billet of 8620 carbon steel. The intermediate club head comprises a bent strike face, allowing a cavity to be formed in the rear via a hot pressing step. The bent strike face was then precision forged to create a final golf club head with a flat strike face and a cavity configured to receive an insert. The insert was then adhered to the cavity. The cavity comprised a similar width and depth to the cavity of the club head used in Example 4 and embodiment 300 described above. The cavity had a width of approximately 8 mm at the top of the cavity and a width of approximately 6.42 mm at the bottom of the cavity. The depth of the cavity was approximately 4 mm. Further, the strike face comprised a top region, middle region, and cavity region as described in embodiment 400 above. The thickness of the middle region was approximately 1.9 mm. The width of the cavity region (i.e., the cavity offset distance) ranged from a minimum thickness of 2.76 to a maximum thickness of 3.73 mm. The exemplary club is a 4 iron with a loft of about 22 degrees.

The control club head used in this comparative example is a traditionally forged blade style iron type club head. The control club head used in this example is different than the control club head used in Example 4. The control head of this example has smaller dimensions than the control club head of Example 4.

Player testing was conducted to directly compare the performance of the exemplary club head and the control club head. Shot data was collected using a launch monitor for every participant. It should also be noted that the exemplary club head used in this example is the same the exemplary club head used in Example 4. However, the test was conducted at a different time of the year and under different weather conditions. The players used in this test performed differently than the players used in the example 4 test. As such, the results of the exemplary club head of each test show these differences in the testing environment.

TABLE 4

| | Exemplary Club Head | Control Club Head |
|---|---|---|
| Ball Speed | 137.8 mph | 135.4 mph |
| Carry Distance | 208.9 yards | 203.1 yards |
| Stat Area | 651 $yd^2$ | 1068 $yd^2$ |

Illustrated in Table 4, the exemplary club head produced faster ball speeds and longer carry distances for the participants when compared to the control club head. Participants saw an increase of approximately 2.4 mph in ball speed and an increase of approximately 5.8 yards of additional carry distances on average using the exemplary club head. Further, the stat area provides a statistical representation of the spatial dispersion seen with a set of shots. Smaller stat areas equate to more precise results. Table 4 shows that both the exemplary club and control club have a similar stat area, wherein the exemplary club performed better. The exemplary club had a stat area of 651 $yd^2$ and the control club had a stat area of 1068 $yd^2$.

These results showed the exemplary club head to provide increased ball speed and distance, while also decreasing the dispersion area compared to the control club head. Increased distance and accuracy are desired by golfers at all levels. In conclusion, the exemplary club head outperformed the control club head due to the improved MOI and CG numbers achieved through the use of the multi-staging forging process described herein. The multi-stage forging process created a rear cavity in the exemplary club head. The rear cavity allowed for additional mass savings so that more mass may be placed lower in the club and at perimeter portions to lower the CG and increase MOI, respectively. The lower CG helps increase ball speed because the lower CG is closer to and more in line with the force line of the club head and ball. The increased MOI helps reduce the stat area by reducing the club heads tendency to twist upon impact with a golf ball.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron golf club, the apparatus, methods, and articles of manufacture described herein may be applicable to other types of golf club such as a wedge-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1: A method of manufacturing a golf club head, the method comprising: providing a billet of at least one material; forming the billet into an intermediate club head body by means of forging, wherein the intermediate body comprises: a sole, a top rail, a strike face, a back wall of the strike face, and a rear portion, wherein the rear portion of the body has an upper edge and a nonlinear outer periphery, wherein the strike face comprises an upper region, and a lower region, wherein the upper region and lower region of the strike face are divided by an intersection plane, wherein the intersection plane is perpendicular to the lower region of the strike face, wherein the strike face is formed at a clearance angle, wherein the clearance angle is measured from the upper region of the strike face to the intersection plane; wherein the clearance angle of the strike face is between 5° and 35°; forming a cavity in the rear portion of the body by means of hot-pressing; bending the strike face to a final angle, by means of forging, into a substantially planar surface arranged for impacting a golf ball, to form the golf club head having a cavity; and wherein the final angle is 90°.

Clause 2: The method of manufacturing the golf club head of clause 1, wherein the golf club head comprises a sole, a top rail, a strike face, a back wall of the strike face, a toe end, a heel end, and a rear portion; wherein the rear portion of the body has an upper edge and a nonlinear outer periphery; wherein the strike face has a heel end, a toe end, an upper region, and a lower region; wherein the upper region and lower region of the strike face are divided by an intersection plane; wherein the intersection plane is perpendicular to the lower region of the strike face.

Clause 3: The method of manufacturing the golf club head of clause 1, wherein the intersection plane is perpendicular to the lower region of the strike face and the strike plane.

Clause 4: The method of manufacturing the golf club head of clause 1, wherein the intersection plane intersects the golf club head at approximately 40-50% of a height of the club head; wherein the height of the club head is measured from the sole of the golf club head to the top rail of the golf club head.

Clause 5: The method of manufacturing the golf club head of clause 1, wherein the cavity formed by the hot-pressing stage comprises a volume ranging between 0.2 in3 and 0.4 in3.

Clause 6: The method of manufacturing the golf club head of clause 1, further comprising: fixing an insert within the cavity.

Clause 7: The method of manufacturing the golf club head of clause 6, wherein the insert can be fixed within the cavity via adhesion, press-fitting, mechanical fastening, or any other suitable methods of securing the insert.

Clause 8: The method of manufacturing the golf club head of clause 7, wherein a percentage of the cavity that is occupied by the insert ranges between 95%-100%.

Clause 9: The method of manufacturing the golf club head of clause 1, wherein the golf club head comprises a loft angle between 19° and 60°

Clause 10: The method of manufacturing the golf club head of clause 1, wherein the billet does not monolithically encase any other material.

Claus 11: The method of manufacturing the golf club head of clause 2, wherein the cavity of the golf club head extends in a direction from the heel end to the toe end.

Clause 12: The method of manufacturing the golf club head of clause 2, wherein the cavity formed by the hot-pressing stage further comprises a cavity axis; wherein the cavity axis passes through a nadir of the cavity; wherein the cavity axis exactly bisects the cavity and is equidistant from the cavity interior surface walls.

Clause 13: The method of manufacturing the golf club head of clause 12, wherein the cavity formed by the hot-pressing stage further comprises a press angle; wherein the press angle is measured from the cavity axis to the intersection plane.

Clause 14: The method of manufacturing the golf club head of clause 12, wherein the press angle ranges between 60°-90°.

Clause 15: The method of manufacturing the golf club head of clause 1, wherein the cavity formed by the hot-pressing stage further comprises a substantially triangular, rectangular, square, semi-circular, parabolic, or trapezoidal cross section.

Clause 16: The method of manufacturing the golf club head of clause 6, wherein the insert that is fixed within the cavity comprises a mass ranging between 1.0 g and approximately 30.0 g.

Clause 17: The method of manufacturing the golf club head of clause 16, wherein the insert that is fixed within the cavity comprises a density ranging between 1.0 g/cc and approximately 20.0 g/cc.

Clause 18: The method of manufacturing the golf club head of clause 10, wherein the billet comprises one or more of the following metals: 8620 alloy steel, S25C steel, carbon steel, maraging steel, stainless steel, stainless steel alloy, tungsten, aluminum, aluminum alloy, or any metal suitable for forging.

Clause 19: The method of manufacturing the golf club head of clause 10, wherein the billet comprises two or more of the following metals: 8620 alloy steel, S25C steel, carbon steel, maraging steel, stainless steel, stainless steel alloy, tungsten, aluminum, aluminum alloy, or any metal suitable for forging.

Clause 20: The method of manufacturing the golf club head of claim 10, wherein the billet comprises two or more metals, wherein at least one of the metals is 8620 alloy steel and at least one of the metals is tungsten.

Clause 21: A forged golf club head comprising: a top rail, a sole opposite the top rail, a hosel, a toe region, a heel region opposite the toe region, a rear, a strike face, a lower rear region, and an upper rear region; wherein: the upper rear region is located above the lower rear region such that the upper rear region comprises the top rail and the lower rear region comprises the sole; the forged golf club head further comprises a forged cavity formed in the lower rear region; the forged cavity comprises a volume between 3.5 cc and 6.5 cc; the strike face comprises a top region, a cavity region, and a middle region located between the top region and cavity region; the top region comprises a first thickness measured perpendicular to the strike face, and a first height measured parallel to the strike face from the top rail to the sole; the middle region comprises a second thickness measured perpendicular to the strike face, and a second height measured parallel to the strike face from the top rail to the sole; the cavity region comprises a minimum thickness and a maximum thickness measured perpendicular to the strike face, and a third height measured parallel to the strike face form the top rail to the sole; the first thickness is greater than the second thickness and less than the minimum thickness; the second height ranges from approximately 4 mm to 7 mm; the forged golf club head is forged from a single solid billet.

Clause 22: The forged golf club head of clause 21, wherein: the strike face defines a geometric center, the geometric center defining an origin for a coordinate system including a x-axis extending parallel to a ground plane and comprises a positive direction toward the heel end when the club head is at an address position, a y-axis extending perpendicular to the ground plane and comprises a positive direction toward the top rail when the club head is at the address position, and a z-axis extending parallel to the ground plane and comprises a positive direction toward the front end when the club head is at the address position; a center of gravity of the golf club head is located within the coordinate system, and includes a CGx location along the x-axis, a CGy location along the y-axis, and a CGz location along the z-axis; wherein: the CGy location ranges from −3 mm to −4 mm.

Clause 23: The forged golf club head of clause 22, wherein center of gravity includes a y'-axis extending perpendicular to the ground plane and comprises a positive direction toward the top rail when the club head is at the address position; wherein a moment of inertia Iyy about the y' axis ranges from 2250 $g*cm^2$ to 2500 $g*cm^2$.

Clause 24: The forged golf club head of clause 23, wherein the club head comprises a mass ranging from 220 grams to 290 grams.

Clause 25: The forged golf club head of clause 21, wherein the cavity comprises a depth which ranges from 2.5 mm to 5 mm measured from the bottom wall to a topmost portion of the rear wall, parallel to a loft plane.

Clause 26: The forged golf club head of clause 25, wherein the cavity comprises a width which ranges from 3.8 mm to 11 mm, measured from the front wall to the rear wall, perpendicular to the loft plane.

Clause 27: The forged golf club head of clause 26, wherein the cavity comprises a top surface plane which intersects a topmost point of the front wall and intersects the topmost point of the rear wall; the cavity comprises a top surface angle which is the angle between the top surface plane the loft plane; and top surface angle ranges between 110 degrees and 130 degrees.

Clause 28: The forged golf club head of clause 21, wherein the second thickness ranges from approximately 1.5 mm to 2.5 mm.

Clause 29: The forged golf club head of clause 28, wherein the minimum thickness ranges from 2 mm to 4 mm; and wherein the maximum thickness ranges from 3.2 mm to 4.5 mm.

Clause 30: The forged golf club head of clause 29, wherein the golf club head further comprises a top rail thickness, measured perpendicular from the loft plane from the strike face to a top rail rear wall; and wherein the top rail thickness ranges from approximately 6.10 mm to 6.65 mm.

Clause 31: A forged golf club head comprising: a top rail, a sole opposite the top rail, a hosel, a toe region, a heel region opposite the toe region, a rear, a strike face, a lower rear region, and an upper rear region; wherein: the upper rear region is located above the lower rear region such that the upper rear region comprises the top rail and the lower rear region comprises the sole; the forged golf club head further comprises a forged cavity formed in the lower rear region; the forged cavity comprises a front wall proximate the strike face, a rear wall space rearwardly of the front wall, a bottom wall, a toe wall, and a heel wall; the front wall, rear wall, bottom wall, toe wall, and heel wall define a cavity volume between 3.5 cc and 6.5 cc; the strike face comprises a top region, a cavity region, and a middle region located between the top region and cavity region; the top region comprises a first thickness measured perpendicular to the strike face, and a first height measured parallel to the strike face from the top rail to the sole; the middle region comprises a second thickness measured perpendicular to the strike face, and a second height measured parallel to the strike face from the top rail to the sole; the cavity region comprises a third thickness measured perpendicular to the strike face, and a third height measured parallel to the strike face from the top rail to the sole; the first thickness is greater than the second thickness and less than the third thickness; the second height ranges from approximately 0.05 inch to 0.125 inch; the forged golf club head is forged from a single solid billet.

Clause 32: The forged golf club head of clause 31, wherein: the strike face defines a geometric center, the geometric center defining an origin for a coordinate system including a x-axis extending parallel to a ground plane and comprises a positive direction toward the heel end when the club head is at an address position, a y-axis extending perpendicular to the ground plane and comprises a positive direction toward the top rail when the club head is at the address position, and a z-axis extending parallel to the ground plane and comprises a positive direction toward the front end when the club head is at the address position; a center of gravity of the golf club head is located within the coordinate system, and includes a CGx location along the x-axis, a CGy location along the y-axis, and a CGz location along the z-axis; wherein: the CGy location ranges from −3 mm to −4 mm.

Clause 33: The forged golf club head of clause 32, wherein center of gravity includes a y'-axis extending perpendicular to the ground plane and comprises a positive direction toward the top rail when the club head is at the address position; wherein a moment of inertia Iyy about the y'-axis ranges from 2250 g*cm$^2$ to 2500 g*cm$^2$.

Clause 34: The forged golf club head of clause 33, wherein the club head comprises a mass ranging from 220 grams to 290 grams.

Clause 35: The forged golf club head of claim 31, wherein the cavity comprises a depth which ranges from 2.5 mm to 5 mm measured from the bottom wall to a topmost portion of the rear wall, parallel to a loft plane.

Clause 36: The forged golf club head of clause 35, wherein the cavity comprises a width which ranges from 3.8 mm to 11 mm, measured from the front wall to the rear wall, perpendicular to the loft plane.

Clause 37: The forged golf club head of clause 36, wherein the cavity comprises a top surface plane which intersects a topmost point of the front wall and intersects the topmost point of the rear wall; the cavity comprises a top surface angle which is the angle between the top surface plane the loft plane; and top surface angle ranges between 110 degrees and 130 degrees.

Clause 38: The forged golf club head of clause 31, wherein the second thickness ranges from approximately 1.5 mm to 2.5 mm.

Clause 39: The forged golf club head of clause 38, wherein the minimum thickness ranges from 2 mm to 4 mm; and wherein the maximum thickness ranges from 3.2 mm to 4.5 mm.

Clause 40: The forged golf club head of clause 39, wherein the golf club head further comprises a top rail thickness, measured perpendicular from the loft plane from the strike face to a top rail rear wall; and wherein the top rail thickness ranges from approximately 6.10 mm to 6.65 mm.

What is claimed is:

1. A forged golf club head comprising:

a top rail, a sole opposite the top rail, a hosel, a toe region, a heel region opposite the toe region, a rear, a strike face, a lower rear region, and an upper rear region; wherein:

the upper rear region is located above the lower rear region such that the upper rear region comprises the top rail and the lower rear region comprises the sole;

the forged golf club head further comprises a forged cavity formed in the lower rear region;

the forged cavity comprises a front wall proximate the strike face, a rear wall space rearwardly of the front wall, a bottom wall, a toe wall, and a heel wall;

the front wall, rear wall, bottom wall, toe wall, and heel wall define a cavity volume between 3.5 cc and 6.5 cc;

the strike face comprises a top region, a cavity region, and a middle region located between the top region and cavity region;

the top region comprises a first thickness measured perpendicular to the strike face, and a first height measured parallel to the strike face from the top rail to the sole;

the middle region comprises a second thickness measured perpendicular to the strike face, and a second height measured parallel to the strike face from the top rail to the sole;

the cavity region comprises a minimum thickness and a maximum thickness measured perpendicular to the strike face, and a third height measured parallel to the strike face from the top rail to the sole;

the first thickness is greater than the second thickness and less than the minimum thickness;

the second height ranges from approximately 4 mm to 7 mm;

the forged golf club head is forged from a single solid billet.

2. The forged golf club head of claim 1, wherein:

the strike face defines a geometric center, the geometric center defining an origin for a coordinate system including a x-axis extending parallel to a ground plane and comprises a positive direction toward the heel end when the club head is at an address position, a y-axis extending perpendicular to the ground plane and comprises a positive direction toward the top rail when the club head is at the address position, and a z-axis extending parallel to the ground plane and comprises a positive direction toward the front end when the club head is at the address position;

a center of gravity of the golf club head is located within the coordinate system, and includes a CGx location along the x-axis, a CGy location along the y-axis, and a CGz location along the z-axis;

wherein:

the CGy location ranges from −3 mm to −4 mm.

3. The forged golf club head of claim 2, wherein center of gravity includes a y'-axis extending perpendicular to the ground plane and comprises a positive direction toward the top rail when the club head is at the address position;

wherein a moment of inertia Iyy about the y'-axis ranges from 2250 g*cm$^2$ to 2500 g*cm$^2$.

4. The forged golf club head of claim 3, wherein the club head comprises a mass ranging from 220 grams to 290 grams.

5. The forged golf club head of claim 1, wherein the forged cavity comprises a depth which ranges from 2.5 mm to 5 mm measured from the bottom wall to a topmost portion of the rear wall, parallel to a loft plane.

6. The forged golf club head of claim 5, wherein the forged cavity comprises a width which ranges from 3.8 mm to 11 mm, measured from the front wall to the rear wall, perpendicular to the loft plane.

7. The forged golf club head of claim 6, wherein the forged cavity comprises a top surface plane which intersects a topmost point of the front wall and intersects the topmost point of the rear wall;

the forged cavity comprises a top surface angle which is the angle between the top surface plane the loft plane; and top surface angle ranges between 110 degrees and 130 degrees.

8. The forged golf club head of claim 1, wherein the second thickness ranges from approximately 1.5 mm to 2.5 mm.

9. The forged golf club head of claim 8, wherein the minimum thickness ranges from 2 mm to 4 mm; and wherein the maximum thickness ranges from 3.2 mm to 4.5 mm.

10. The forged golf club head of claim 9, wherein the golf club head further comprises a top rail thickness, measured perpendicular from a loft plane from the strike face to a top rail rear wall; and wherein the top rail thickness ranges from approximately 6.10 mm to 6.65 mm.

11. A forged golf club head comprising:

a top rail, a sole opposite the top rail, a hosel, a toe region, a heel region opposite the toe region, a rear, a strike face, a lower rear region, and an upper rear region; wherein:

the upper rear region is located above the lower rear region such that the upper rear region comprises the top rail and the lower rear region comprises the sole;

the forged golf club head further comprises a forged cavity formed in the lower rear region;

the forged cavity comprises a front wall proximate the strike face, a rear wall space rearwardly of the front wall, a bottom wall, a toe wall, and a heel wall;

the front wall, rear wall, bottom wall, toe wall, and heel wall define a cavity volume between 3.5 cc and 6.5 cc;

the strike face comprises a top region, a cavity region, and a middle region located between the top region and cavity region;

the top region comprises a first thickness measured perpendicular to the strike face, and a first height measured parallel to the strike face from the top rail to the sole;

the middle region comprises a second thickness measured perpendicular to the strike face, and a second height measured parallel to the strike face from the top rail to the sole;

the cavity region comprises a third thickness measured perpendicular to the strike face, and a third height measured parallel to the strike face from the top rail to the sole;

the first thickness is greater than the second thickness and less than the third thickness;

the second height ranges from approximately 0.05 inch to 0.125 inch;

the forged golf club head is forged from a single solid billet.

12. The forged golf club head of claim 11, wherein:

the strike face defines a geometric center, the geometric center defining an origin for a coordinate system including a x-axis extending parallel to a ground plane and comprises a positive direction toward the heel end when the club head is at an address position, a y-axis extending perpendicular to the ground plane and comprises a positive direction toward the top rail when the club head is at the address position, and a z-axis extending parallel to the ground plane and comprises a positive direction toward the front end when the club head is at the address position;

a center of gravity of the golf club head is located within the coordinate system, and includes a CGx location along the x-axis, a CGy location along the y-axis, and a CGz location along the z-axis;

wherein:

the CGy location ranges from −3 mm to −4 mm.

13. The forged golf club head of claim 12, wherein center of gravity includes a y'-axis extending perpendicular to the ground plane and comprises a positive direction toward the top rail when the club head is at the address position;

wherein a moment of inertia Iyy about the y'-axis ranges from 2250 $g*cm^2$ to 2500 $g*cm^2$.

14. The forged golf club head of claim 13, wherein the club head comprises a mass ranging from 220 grams to 290 grams.

15. The forged golf club head of claim 11, wherein the forged cavity comprises a depth which ranges from 2.5 mm to 5 mm measured from the bottom wall to a topmost portion of the rear wall, parallel to a loft plane.

16. The forged golf club head of claim 15, wherein the forged cavity comprises a width which ranges from 3.8 mm to 11 mm, measured from the front wall to the rear wall, perpendicular to the loft plane.

17. The forged golf club head of claim 16, wherein forged the cavity comprises a top surface plane which intersects a topmost point of the front wall and intersects the topmost point of the rear wall;

the forged cavity comprises a top surface angle which is the angle between the top surface plane the loft plane; and top surface angle ranges between 110 degrees and 130 degrees.

18. The forged golf club head of claim 11, wherein the second thickness ranges from approximately 1.5 mm to 2.5 mm.

19. The forged golf club head of claim 18, wherein the third thickness ranges from 2 mm to 4.5 mm.

20. The forged golf club head of claim 19, wherein the golf club head further comprises a top rail thickness, measured perpendicular from a loft plane from the strike face to a top rail rear wall; and wherein the top rail thickness ranges from approximately 6.10 mm to 6.65 mm.

* * * * *